United States Patent [19]

Taylor

[11] 4,119,146

[45] Oct. 10, 1978

[54] SURFACE CONTROLLED SUB-SURFACE SAFETY VALVE

[75] Inventor: Frank H. Taylor, Carrollton, Tex.

[73] Assignee: Otis Engineering Corporation, Dallas, Tex.

[21] Appl. No.: 798,180

[22] Filed: May 18, 1977

[51] Int. Cl.[2] ..... E21B 43/12

[52] U.S. Cl. ..... 166/72; 137/111; 166/321; 251/28

[58] Field of Search ..... 166/72, 321; 251/28, 251/29; 137/111, 510

[56] References Cited

U.S. PATENT DOCUMENTS

| | | | |
|---|---|---|---|
| 2,594,831 | 4/1952 | Walton | 137/111 |
| 2,599,713 | 6/1952 | Kagay et al. | 137/111 |
| 2,751,182 | 6/1956 | Snyder | 251/28 |
| 2,751,923 | 6/1956 | Towler et al. | 251/28 |
| 3,292,706 | 12/1966 | Grimmer et al. | 166/321 |
| 3,627,042 | 12/1971 | McGowen, Jr. | 137/510 |
| 3,860,066 | 1/1975 | Pearce et al. | 166/72 |
| 4,005,751 | 2/1977 | Page, Jr. | 166/321 |

*Primary Examiner*—James A. Leppink
*Attorney, Agent, or Firm*—Vinson & Elkins

[57] ABSTRACT

A surface controlled subsurface safety valve having an operator and a pilot valve. The pilot valve controllably communicates pressurized control fluid to affect the operator and pressure balances the operator. This abstract is neither intended to define the scope of the invention, which, of course, is measured by the claims, nor is it intended to be limiting in any way.

13 Claims, 24 Drawing Figures

30
28
34
22
32
20
40
36
32a
26
24

30'
28'
34'
22'
20'
32'
130
24'

100a
42
106
108a
124
122
32a
126
100
100b
108b
108
104
100c 100a
42
124
108a
122
32a
126
100b
108b
104
100c

SURFACE CONTROLLED SUB-SURFACE SAFETY VALVE

BACKGROUND OF THE INVENTION

1. Field of the Invention

This invention relates to a surface controlled subsurface safety valve for controlling flow within a well. A valve closure element moves to a position permitting subsurface flow when pressurized control fluid is effective upon a valve operator. The invention also relates to a pilot valve for controllably communicating pressurized control fluid to the valve operator and for pressure balancing the valve operator.

2. The Prior Art

A common limitation of present surface controlled subsurface safety values is that a large volume of pressurized control fluid must be displaced against several fluid forces to permit valve closure.

Subsurface safety valves are designed to be failsafe, e.g., normally closed. A closure element is generally urged to a position closing the subsurface flow path by a spring, as disclosed in U.S. Pat. No. 3,696,868, and/or dome pressure chamber, as disclosed in U.S. Pat. No. 3,860,066.

At increasing well depths, the responsiveness of safety valves to decreases in control pressure and the ability of safety valves to close quickly both decrease. For a subsurface safety valve, controlled with a single conduit as closed in U.S. Pat. Nos. 3,233,860; 3,703,193; and 3,860,066, the fluid forces resisting closure are created by a hydrostatic head of fluid within the single conduit. The spring and/or dome pressure chamber must exert a force sufficient to displace control fluid from the control pressure chamber of the safety valve into the single conduit. Displacement of the control fluid is retarded by a hydrostatic pressure force of the fluid in the control conduit, by the inertia of the fluid in the control conduit, and by the friction force developed between the control fluid and the control conduit. Due to space, size, strength of materials, and other design limitations, the ability to swiftly overcome these forces and swiftly displace control fluid from the control pressure chamber with a single spring, multiple spring arrangement, and/or dome pressure chamber is limited.

To counteract the hydrostatic pressure force, some surface controlled subsurface safety valves have a second, balance conduit (See U.S. Pat. No. 3,696,868). Through the balance conduit, pressurized fluid may be communicated to the safety valve both to produce a force counter-acting the force created by the hydrostatic pressure in the control conduit and to assist the spring and/or dome pressure in moving the closure element to a position closing the subsurface flow path. Even with a control conduit and a balance conduit, control fluid must be displaced from the valve operating piston chamber to the control conduit during valve closure. The fluid displacement is still retarded by inertia forces and by the friction forces.

For subsurface safety valves positioned at depths of several thousand feet, the combined forces retarding fluid displacement become quite large.

The speed at which control fluid is displaced from the valve operating piston chamber, dictates the closing speed of the valve closure element. Present surface controlled subsurface safety valves, relying upon spring force and/or dome pressure force, must displace a relatively large volume of fluid against the combined forces retarding fluid displacement created by the fluid in the control conduit. To displace the required volume of pressurized control fluid, and therefore to close the subsurface safety valve, can take as long as one hour. When the time is of the essence for closure of a subsurface safety valve, an hour is simply too long.

The communication of control fluid between the well surface and the subsurface safety valve may include controlled fluid communication through a side pocket receptacle of a side pocket mandrel (See U.S. Pat. No. 3,627,042).

U.S. Pat. No. 4,005,751 discloses utilizing a pilot valve, which is pressure balanced to well fluids, to control communication of control fluid. In a first position of the pilot valve, pressurized control fluid may be effective to open the subsurface safety valve. In a second position of the pilot valve, pressurized control fluid may be effective to close the subsurface safety valve. To both open and close the subsurface safety valve, control fluid pressure is required to exceed well pressure. If the control line is ruptured at the surface, hydrostatic control fluid pressure may not exceed the pressure of flowing well fluids. Under those conditions, a subsurface valve as disclosed in U.S. Pat. No. 4,005,751 may not close.

OBJECTS OF THE INVENTION

It is an object of this invention to provide a surface controlled subsurface safety valve that closes without requiring that the valve's operator displace control fluid against fluid forces due to the presence of control fluid in a control conduit.

It is another object of this invention to provide a surface controlled subsurface safety valve wherein the displacement of a relatively small volume of pressurized control fluid against fluid forces due to the presence of control fluid in a control conduit enables closure of the valve.

It is another object of this invention to substantially remove the depth limitations of surface controlled subsurface safety valves.

It is another object of this invention to provide a surface controlled subsurface safety valve having both a control conduit and a balance conduit that does not require the displacement of fluid from the control pressure chamber into the control conduit and from the balance conduit into the balance pressure chamber before the valve can close.

It is another object of this invention to provide a surface controlled subsurface safety valve that can close more quickly than present surface controlled subsurface safety valves.

It is another object of this invention to provide a surface controlled subsurface safety valve that includes an operating position wherein the valve's control pressure responsive operator is substantially pressure balanced to enable closure more quickly than can be obtained for present surface controlled subsurface safety valves.

It is another object of this invention to provide a pilot valve that controls communication of fluid between the well surface and a fluid controlled subsurface safety valve in a manner to enable obtainment of the previous objects.

These and other objects and features of advantage of this invention will be apparent from the drawings, the detailed description, and the appended claims.

BRIEF DESCRIPTION OF THE DRAWINGS

In the drawings wherein like numerals indicate like parts and wherein illustrative embodiments of this invention are shown.

DETAILED DESCRIPTION OF THE PREFERRED EMBODIMENTS

Wells are often equipped with subsurface safety valves. For various reasons, it is desirous to control at least some of these subsurface safety valves from the surface. Therefore, to control the subsurface safety valve, one or more conduits extend between the surface and the subsurface safety valve. Generally, the subsurface safety valve is normally closed. Fluid within a control conduit is pressurized to open the subsurface safety valve. Severance of the control conduit and/or loss of operating pressure at the surface results in the subsurface safety valve returning to its normally closed position.

Surface controlled subsurface safety valves in accordance with this invention are capable of closing faster than present surface controlled subsurface safety valves. Faster closure results because the safety valve's operator does not have to displace a relatively large volume of pressurized control fluid against the fluid forces due to fluid presence in a control conduit. Instead, a relatively small volume of pressurized control fluid is displaced by a pilot valve. When the pilot valve is closed, the valve operator is relieved from the forces due to fluid presence in a control conduit. Preferably, the valve operator is also fluid pressure balanced when the pilot valve is closed. With the operator relieved from the affects of fluid forces due to fluid presence in a control conduit, and with the operator pressure balanced, the safety valve may quickly close the subsurface flow path.

Figure 1:
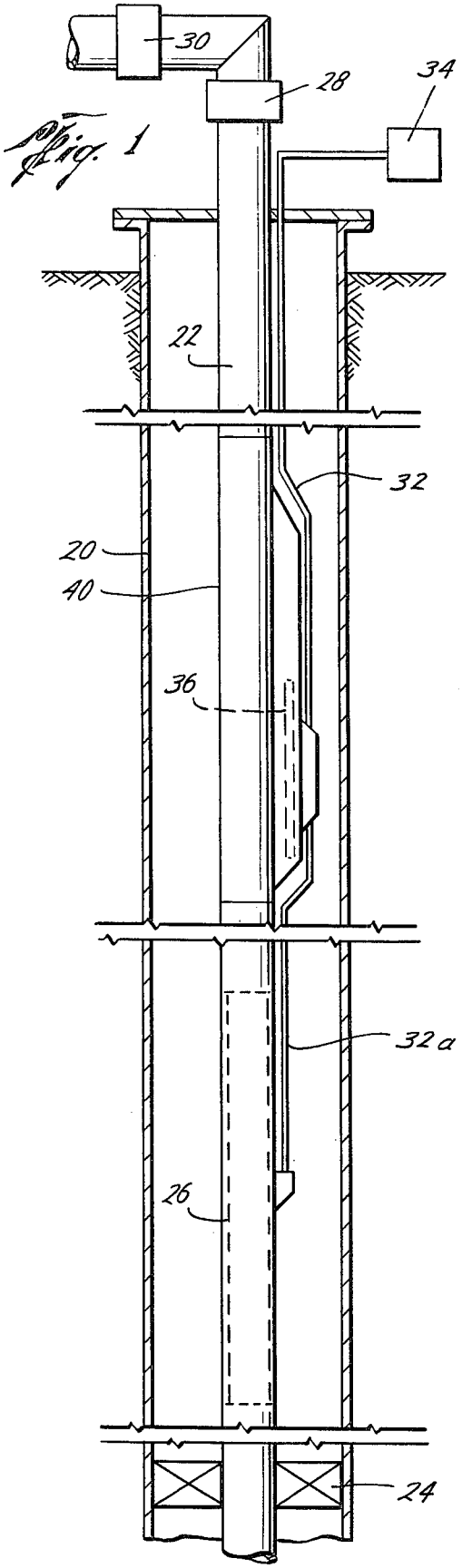
FIG. 1 is a schematic illustration of a well installation having a surface controlled subsurface safety valve in accordance with a first embodiment of this invention.

FIG. 1 illustrates one well installation utilizing this invention. The well is cased with the normal casing string 20. Through the casing string 20 extends a tubing string 22. Fluids from a producing formation (not shown) may be confined to within the tubing string 22 by sealing off the annulus between the tubing string 22 and the casing 20 with packer means 24. Fluid flow through the tubing string 22 may be controlled at a subsurface location by subsurface safety valve 26 (shown in dotted form in FIG. 1). At the well surface, flow through the tubing string 22 may be controlled by surface valves 28 and 30. To control the subsurface safety valve 26 from the surface, conduit means 32 extends between the valve 26 and the surface. At the surface, control fluid is pressurized or depressurized and pumped into conduit means 32 by operating manifold 34. Pressurizing conduit means 32 opens safety valve 26. Depressurizing conduit means 32 permits closure of safety valve 26.

In accordance with this invention, pilot valve means 36 (illustrated in dotted form in FIG. 1) is located in close proximity to the subsurface safety valve 26. At its subsurface location, pilot valve means 36 controls the flow of control fluid through conduit means 32 to the subsurface safety valve 26. Thus, when it is desired to open the subsurface safety valve 26, pilot valve means 36 is opened. Thereafter pressurized control fluid is effective upon the operator of the subsurface safety valve 26 to open the subsurface flow path through the subsurface safety valve 26. When it is desired to close the subsurface flow path through safety valve 26, fluid within conduit means 32 is depressurized. Pilot valve means 36 closes. The operator of the subsurface safety valve 26 is relieved from the fluid forces due to the presence of control fluid within conduit means 32 above pilot valve means 36. Additionally, the operator is substantially fluid pressure balanced. The safety valve 26 is thereby permitted to quickly close the subsurface flow path. During valve closure, forces due to fluid presence within control conduit means 32 do not affect the safety valve 26. Additionally, the valve operator is not moved against a large pressure differential.

In the embodiment illustrated in FIGS. 1 through 7, pilot valve means 36 is installable within a side pocket receptacle 38 of side pocket mandrel 40. The subsurface safety valve 26 is a wire line retrievable, surface controlled subsurface tubing safety valve. It is illustrated in FIG. 2B locked in a landing nipple 42 in the tubing string 22 by locking mandrel 44. It will be appreciated that although a portion 32*a* of control conduit means 32 extends between side pocket mandrel 40 and the landing nipple 42, that, because the side pocket mandrel 40 is in close proximity to the landing nipple 42, this portion 32*a* of control conduit means 32 is relatively short. Therefore, forces resisting movement of the valve operator developed by control fluid within that portion 32*a* will be relatively small when compared with the forces resisting displacement of fluid in the control conduit means 32 extending above side pocket mandrel 40.

Figure 3:
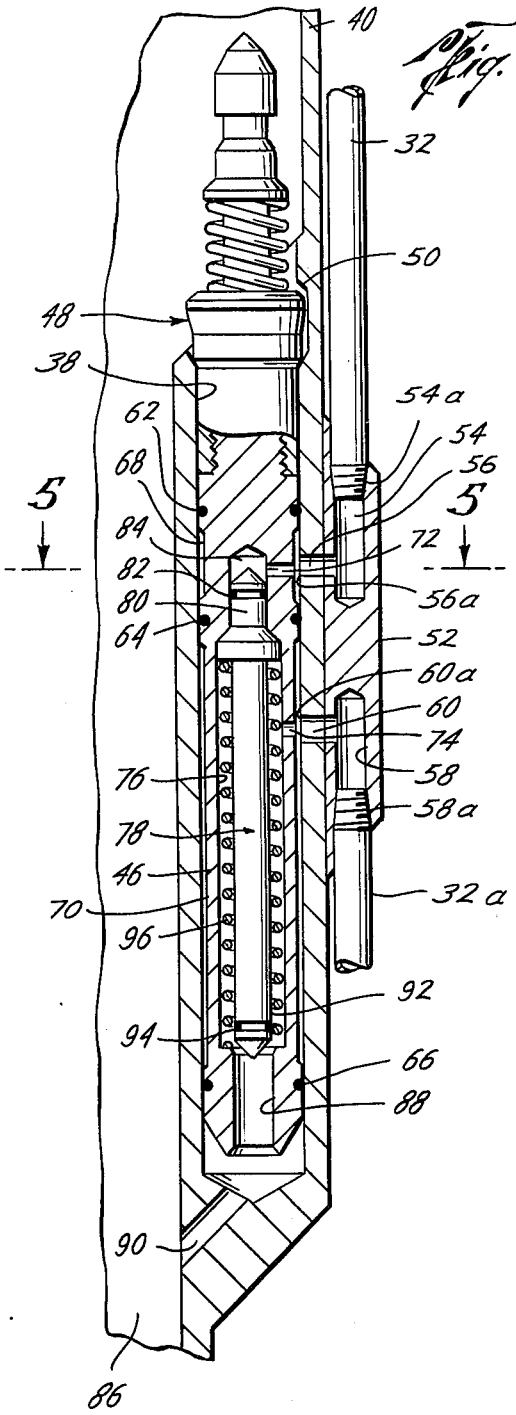
FIG. 3 is a view, partly in section and partly in elevation, of a first embodiment of a pilot valve useable in the well installation of FIG. 1, with the pilot valve closed.
Figure 6:
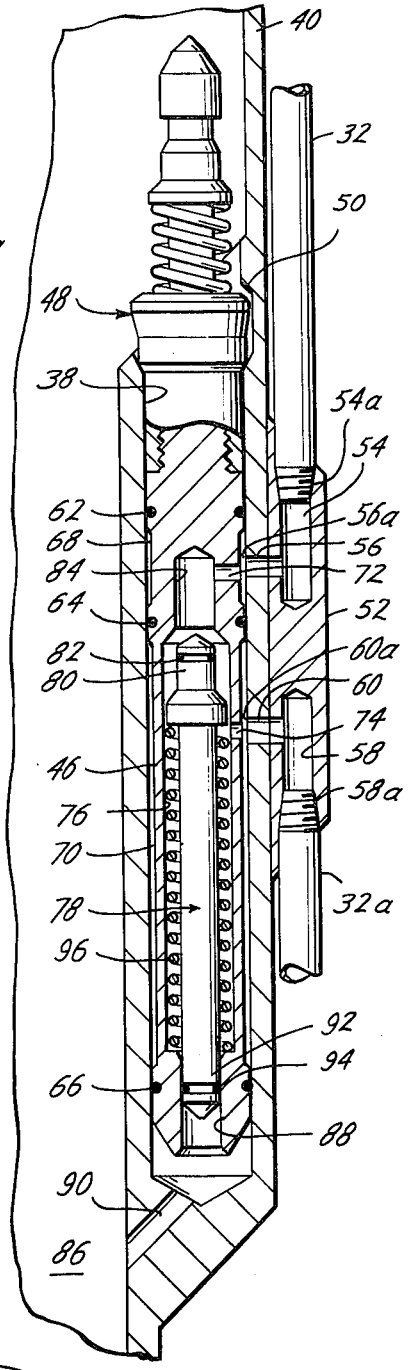
FIG. 6 is a view, partly in section and partly in elevation of the pilot valve of FIG. 3 with the pilot valve open.
Figure 5:
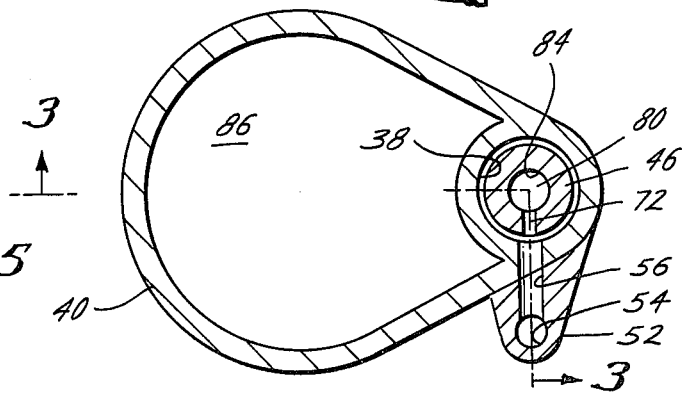
FIG. 5 is a cross-sectional view taken along line 5—5 of FIG. 3.

The detailed structure of a pilot valve means 36 for this first embodiment of a surface controlled subsurface safety valve is illustrated in FIGS. 3, 5 and 6. In FIG. 3, the pilot valve is closed while in FIG. 6 the pilot valve is opened. Pilot valve means 36 comprises pilot valve housing means 46, a flow passage through the pilot valve housing means 46, and a valve means to control flow through the flow passage.

Pilot valve housing means 46 is adapted to be received within the side pocket receptacle 38 of side pocket mandrel 40. Locking means 48 on pilot valve housing means 46 engages locking shoulder means 50 within the side pocket mandrel 40 to hold the pilot valve means 36 in place.

Since pilot valve means 36 is spaced from the subsurface safety valve 26, albeit in close proximity thereto when compared with other distances in the well, means are provided for communicating pressurized control fluid from control conduit means 32, through pilot valve means 36, to the subsurface safety valve 26. With pressurized control fluid being routed through pilot valve means 36, pilot valve means 36 can selectively render fluid within conduit means 32 above pilot valve means 36 incapable of affecting the operation of the subsurface safety valve 26. Pilot valve means 36 additionally enables substantial fluid pressure balancing of the operator of the subsurface safety valve 26.

For communicating the pressurized control fluid from control conduit means 32 through pilot valve means 36 and to the subsurface safety valve 26, connector means 52 is attached to the side pocket mandrel 40 adjacent to the side pocket receptacle 38 and pilot valve means 36 is sealed within the side pocket receptacle 38. Valved ports within pilot valve means 36 and co-communicating ports through the side pocket mandrel 40 and connector means 52 enable controlled passage of fluid from control conduit means 32, through pilot valve means 36, and to the subsurface safety valve 26.

Control fluid communicates between the surface and pilot valve means 36 through control conduit means 32, connector means 52 and the side pocket mandrel 40. Connector means 52 includes an upper blind bore 54 having a thread 54*a* at its upper end. To the thread 54*a* is attached the lower end of control conduit means 32. Side port means 56, extending through connector means 52 and side pocket mandrel 40, communicates between blind bore 54 and the interior of the side pocket receptacle 38.

Passage means extends between pilot valve means 36 and subsurface safety valve 26 for communicating fluid therebetween. A portion of this passage means is formed by conduit means 32*a* extending between the side pocket mandrel 40 and the subsurface safety valve 26. Another portion of the passage means extends through connector means 52 and the side pocket mandrel 40. Connector means 52 includes a lower blind bore 58. A thread 58*a* at the lower end of blind bore 58 receives the upper end of conduit means 32*a*. Communicating between lower blind bore 58 and the interior of the side pocket receptacle 38 is another side port means 60 extending through connector means 52 and side pocket mandrel 40. Side port means 60 is spaced from first side port means 56.

Pilot valve means 36 is sealed within the side pocket receptacle 38 by spaced seal means 62, 64, and 66 carried on pilot valve housing means 46. The spaced seal means 62, 64 and 66 provide two pressure regions, 68 and 70, along the length of pilot valve means 36. One pressure region 68 is adjacent to the opening 56*a* of first side port means 56 into the side pocket receptacle and is, therefore, affected by fluid within control conduit means 32. The other pressure region 70 is adjacent to the opening 60*a* of second side port means 60 into the side pocket receptacle 38. It is, therefore, in communication with fluid in the passage means between pilot valve means 36 and the subsurface safety valve 26.

Pilot valve means 36 includes valve means to control flow between the spaced pressure regions 68 and 70. Fluid passage between conduit means 32 and the subsurface safety valve 26 is thereby controlled. First port means 72, in pilot valve housing means 46, has an opening at the exterior surface of pilot valve housing means 46 in the first pressure region 68. First port means 72 thus is in fluid communication with fluid within control conduit means 32. Second port means 74, in pilot valve housing means 46, has an opening at the exterior surface of pilot valve housing means 46 in the other pressure region 70. Thus, second port means 74 is in fluid communication with the subsurface safety valve 26. Between the first and second port means 72 and 74, respectively, extends pilot valve chamber means 76. Pilot valve chamber means 76 and second port means 74 form another portion of the passage means which communicates between control conduit means 32 and the subsurface safety valve 26.

Disposed within pilot valve chamber means 76 is pilot valve member means 78. For preventing fluid flow through pilot valve means 36 between first port means 72 and second port means 74, one end of pilot valve member means 78 comprises one valve head means 80. This one pilot valve head means 80 carries seal means 82 and is adapted to be received within seal bore means 84. Seal bore means 84 forms one end of pilot valve chamber means 76. First port means 72 opens into seal bore means 84 at one extremity of pilot valve chamber means 76. When pilot valve member means 78 is in its first position (See FIG. 3), pilot valve head means 80 is disposed within seal bore means 84 and seal means 82 seals between first seal bore means 84 and the one pilot valve head means 80. Fluid flow between first port means 72 and second port means 74 is thereby prevented. The one valve means of pilot valve means 36 thus comprises the one pilot valve head means 80, first seal means 82, and seal bore means 84.

Preferably, when the one valve means of pilot valve means 36 is in its first position preventing flow between first port means 72 and second port means 74, pilot valve means 36 additionally enables at least a substantial pressure balancing of the safety valve's operator. To pressure balance the operator, valved passageway means communicates between pilot valve chamber means 76 and the bore 86 extending through side pocket mandrel 40 when the one valve means is in its first position. (The side pocket mandrel bore 86 provides another portion of the controlled subsurface flow path through the tubing string 12.) This passageway means may comprise a lower bore 88 in pilot valve housing means 46 and a port 90 in side pocket mandrel 40. The lower bore 88 communicates between pilot valve chamber means 76 and the interior of the side pocket receptacle 38 at the lower end of the pilot valve housing means 46. Port 90 communicates between the interior of side pocket receptacle 38 and the bore 86 of side pocket mandrel 40.

When pilot valve member means 78 is in the position shown in FIG. 6, with the one valve means open, pressurized fluid can communicate through pilot valve means 36 between control conduit means 32 and the subsurface safety valve 26. To prevent this pressurized fluid from being dissipated through passageway means, another valve means within pilot valve means 36 prevents flow through passageway means when the one valve means permits flow. This other valve means comprises another pilot valve head means 92 on the lower end of pilot valve member means 78, seal means 94 carried thereon, and second seal bore means 88. Seal means 94 seals between pilot valve head means 92 and this second seal bore means 88 when pilot valve head means 92 is disposed therein (see FIG. 6).

Thus, pilot valve means 36 includes two-way valve means. In a first operative position of pilot valve means 36 (See FIG. 3), one portion of the two-way valve means prevents flow between control conduit means 32 and the operator of the subsurface safety valve 26. The other portion of the two-way valve means enables at least a substantial pressure balancing of the operator of the subsurface safety valve 26. In a second operative position of pilot valve means 36 (See FIG. 6), the one portion of the two-way valve means permits flow between control conduit means 32 and the valve operator. The other portion of two-way valve means prevents pressure balancing of the operator.

So that pressurized control fluid is effective to open the subsurface safety valve 26 only under selective, surface controlled conditions, pilot valve means 36 is normally in its first operative position. To normally maintain pilot valve means 36 in its first operative position, pilot valve means 36 includes means 96 for resiliently biasing pilot valve member means 78 to its position shown in FIG. 3. This means 96 for resiliently biasing the pilot valve member means 78 comprises spring means 96.

For controllably moving pilot valve means 36 from its first operative position to its second operative position, pilot valve means 36 includes a pressure responsive means for moving pilot valve member means 78 to the position shown in FIG. 6. When pilot valve means 78 is in the position shown in FIG. 3, the one valve means, comprising pilot valve head means 80, seal means 82, and seal bore means 84, additionally functions as this pressure responsive means. Pressurized fluid in the seal bore means 84 above seal means 82 is effective across seal means 82 to produce a force which acts in opposition to spring means 96. When seal bore means 84 is pressurized a sufficient amount, pilot valve member means 78 moves downwardly against the force of spring means 96. It will be noted that the seal means 82 and 94 are spaced on pilot valve member means 78 and that seal means 94 enters the second seal bore means 88 before seal means 82 leaves the first seal bore means 84. Therefore, when pressurized fluid has forced pilot valve member means 78 downwardly a sufficient amount, the other valve means within pilot valve means 36, comprising the other pilot valve head means 92, the second seal bore means 88, and seal means 94, functions as the pressure responsive means. When the other valve means functions as the pressure responsive means, pressurized fluid is effective across seal means 94. As long as the fluid is pressurized a sufficient amount, a force, generated by the pressure differential across seal means 94, acts in opposition to the force of spring means 96 and maintains pilot valve member means 78 in the position shown in FIG. 6.

A subsurface safety valve 26 that may be used in a well installation (as in FIG. 1) with pilot valve means 36 is illustrated in greater detail in FIGS. 4A and 4B, and 7A and 7B. The illustrated subsurface safety valve is a wire line retrievable, surface controlled subsurface tubing safety valve.

The subsurface safety valve includes a valve housing means 100 for defining the controlled subsurface flow path, valve closure means 102 associated with valve housing means 100 for controlling flow through the subsurface flow path, and means for moving valve closure means 102 between its positions opening and closing the subsurface flow path.

Valve housing means 100 includes interconnected tubular sections **100*a*, 100*b*, 100*c*, 100*d*, and 100*e*. Sealing means 104, carried on valve housing means 100, seals between valve housing means 100 and the landing nipple 42 in the well tubing string 22. Subsurface fluid flow is thereby confined to the flow path defined by bore 106 extending through valve housing means 100**.

Valve closure means 102 controls flow through this subsurface flow path. The illustrated valve closure means 102 is disposed within the bore 106 of valve housing means 100 and is movable between a first position closing the bore 106 (see FIG. 4B) and a second position opening the bore 106 (see FIG. 7B).

Operator means, generally indicated at 108, is axially movable within the bore 106 of valve housing means 102 and moves the valve closure means 102 between its positions opening and closing the bore 106. Operator means includes interconnected sections **108*a*, 108*b* and 108*c***.

Figure 4A:
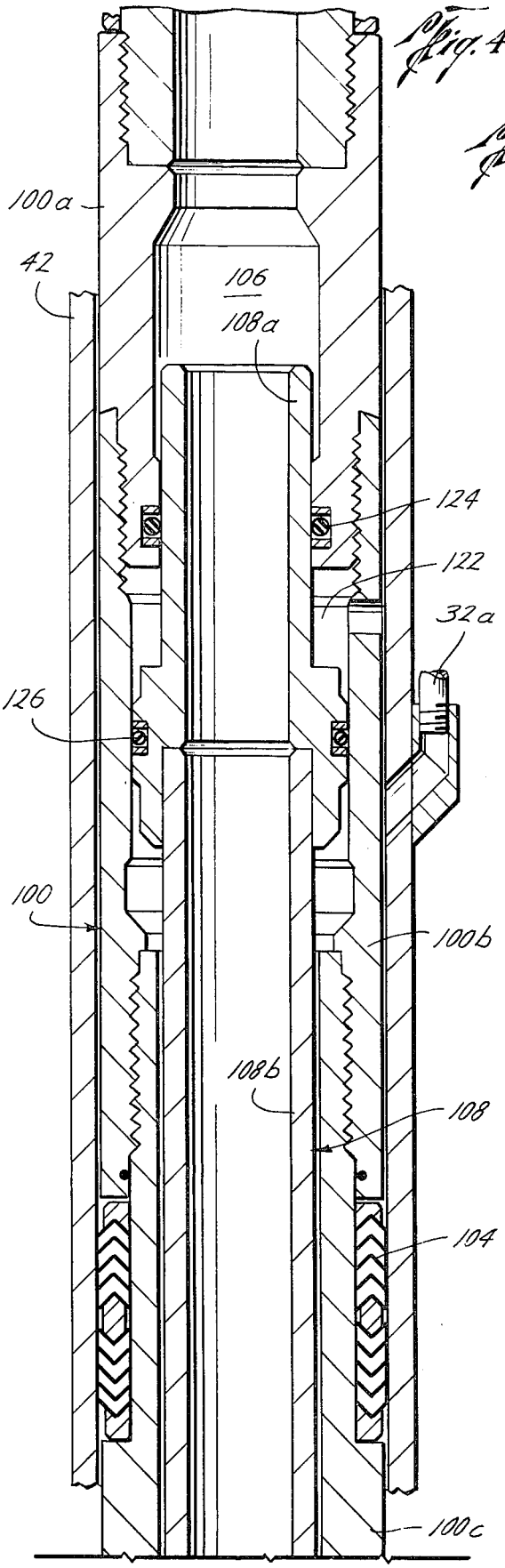
FIGS. 4A and 4B are continuation views of one form of a subsurface safety valve useable in the well installation of FIG. 1 with the safety valve closed.
Figure 7A:
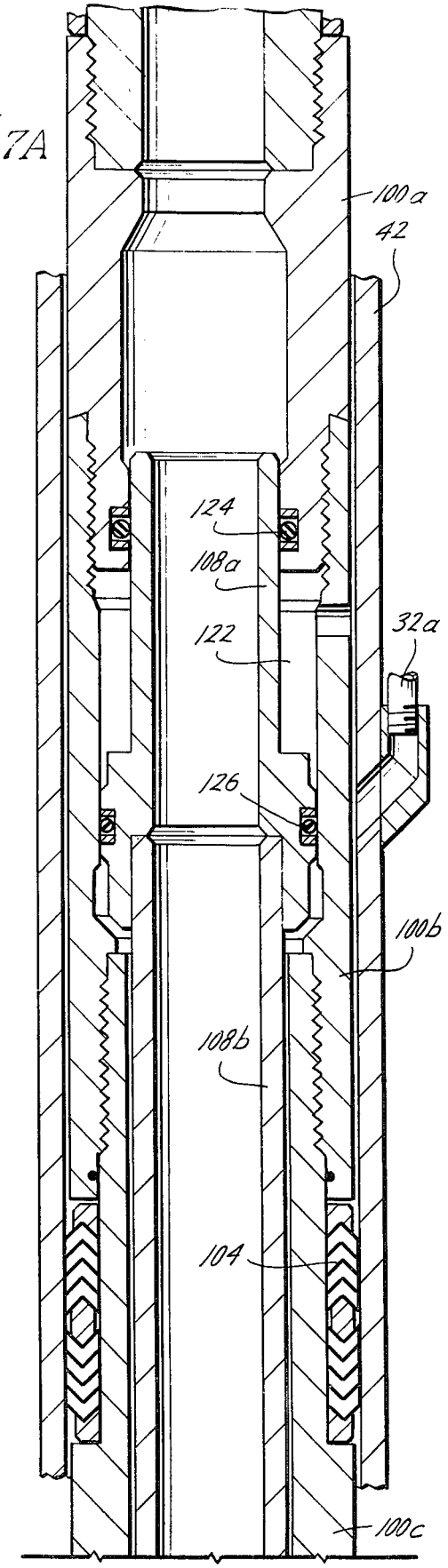
FIGS. 7A and 7B are continuation view of the subsurface safety valve of FIGS. 4A and 4B with the safety valve open.
Figure 4B:
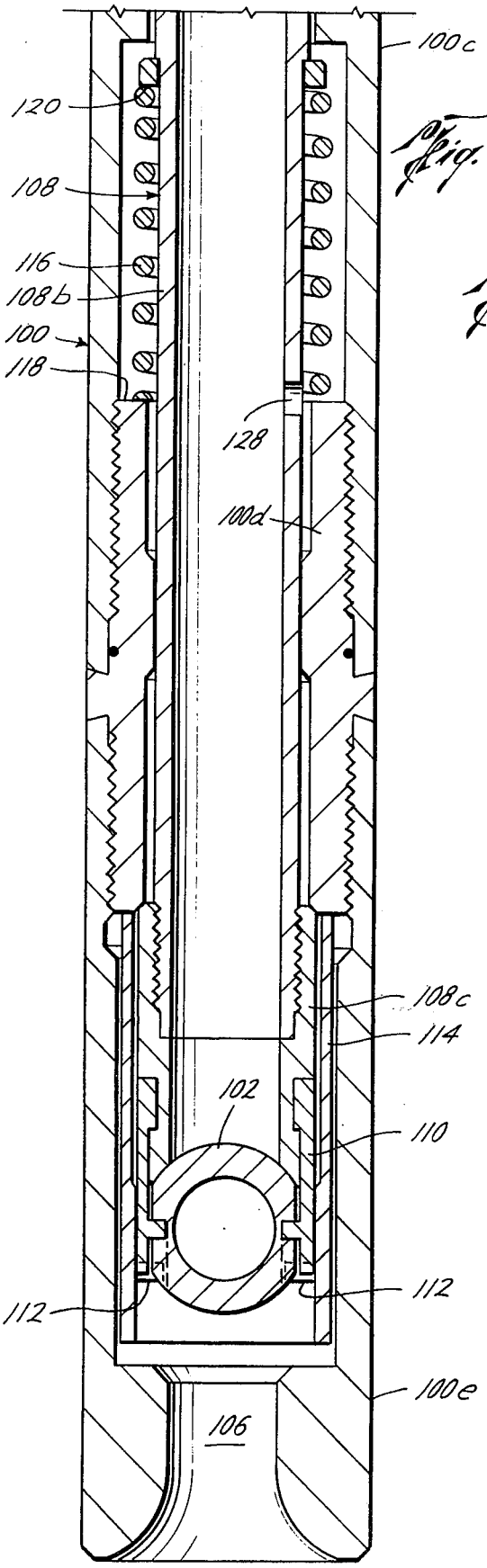
Figure 7B:
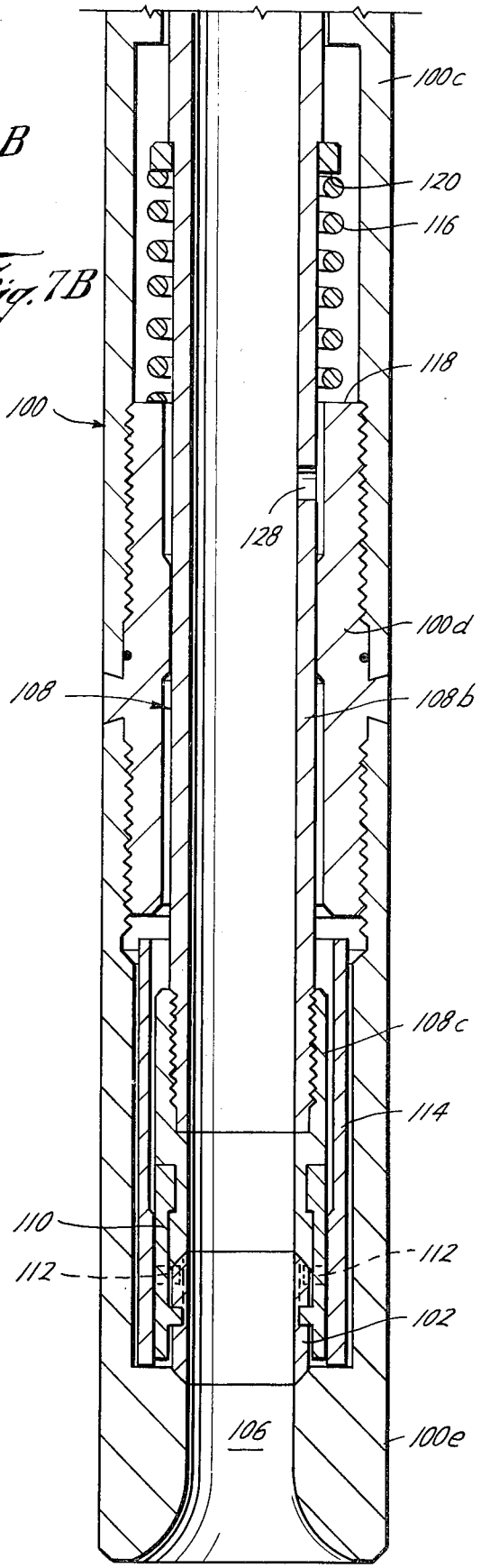

For the illustrated subsurface safety valve, valve closure 102 is pivotally mounted on finger means 110 depending from operator means 108 and pivot means 112 (shown in dotted form in FIGS. 4B and 7B) of lost motion sleeve 114. When operator means 108 is in its first upward position (as shown in FIGS. 4A and 4B), valve closure means 102 is pivoted upwardly to its position closing the flow path through the bore 106. When operator means 108 is moved to its second, downward position (as shown in FIGS. 7A and 7B), valve closure means 102 is pivoted downwardly to its position opening the flow path through the bore 106.

To provide for a failsafe, normally closed, subsurface safety valve, the subsurface safety valve 26 includes means 116 for resilient urging operator means 108 to its first upward position wherein valve closure means 102 closes the flow path through the bore 106. Such means 116 for resiliently urging may be spring means 116 disposed between an upwardly facing shoulder 118 on housing section 100*d* and downwardly facing shoulder 120 carried by operator means 108.

For opening the subsurface safety valve 26, the safety valve 26 includes means responsive to control pressure, including control pressure chamber means 122 formed within valve housing means 100 between valve housing means 100 and operator means 108. When control pressure chamber means 122 is pressurized a minimal amount, operator means 108 is moved to its second, downward, position wherein valve closure means 102 opens the flow path through the bore 106. The pressurization of control pressure chamber means 122 is effective to move operator means 108 to its second downward position because of the differential piston area created by two annular seal means 124 and 126 between valve housing means 100 and operator means 108 which additionally define control pressure chamber means 122.

The seal effective areas of the two seal means 124 and 126 are affected by fluid within the housing bore 106 and within control pressure chamber means 122. Well fluids within the housing bore 106 act across a first seal effective area of seal means 124 and produce a force tending to move operator means 108 to its second position. Additionally, well fluids within the housing bore 106 communicate through port means 128 and act across a second seal effective area of seal means 126 to produce a force tending to move operator means 108 to its first position. Fluid within control pressure chamber means 122 is effective across its differential piston area (e.g. the second seal effective area of seal means 126 minus the first seal effective area of seal means 124) and produces a force tending to move operator means 108 to its second position.

In operation, the surface controlled subsurface safety valve 26 opens the subsurface flow path when control fluid within control conduit means 32 is pressurized at the surface. However, the subsurface safety valve 26 is capable of quickly closing. During valve closure the large volume of control fluid within the safety valve's control pressure chamber means 122 is not displaced against fluid forces created by the presence of control fluid within control conduit means 32.

When the tubing string 22 is being run in the well, the landing nipple 42 is positioned therein. In close proximity to the landing nipple 42, side pocket mandrel 40 is positioned in the tubing string 22. Control conduit means 32 extends from the surface to side pocket mandrel 40 and is attached thereto by connector means 52. Between the side pocket mandrel 40 and the landing nipple 42 extends another portion 32*a* of control conduit means.

The subsurface safety valve 26 may be run on a wire line, or other means, and landed and locked in the landing nipple with locking mandrel 44.

Pilot valve means 36 may be positioned in side pocket receptacle 38 prior to running the side pocket mandrel 46 in the well or it may be installed within the side pocket receptacle 38 with a kickover tool as disclosed in U.S. Pat. No. 3,837,398, the entire disclosure of which is hereby incorporated by reference for all purposes. Once the subsurface safety valve 26 and pilot valve means 36 have been installed, subsurface flow through the safety valve 26 may be controlled from the surface in accordance with this invention.

When control fluid in control conduit means 32 is not pressurized a sufficient amount, pilot valve means 36 will prevent control fluid from communicating between control conduit means 32 and the subsurface safety valve 26 (as illustrated in FIG. 3). Therefore, there will not be that minimal pressurization of fluid within control pressure chamber means 122 required to move operator means 108 from its first position. The flow path through the subsurface safety valve 26 will remain closed (as illustrated in FIGS. 4A and 4B). Although fluids may be present within the housing bore 106 (and within the side pocket mandrel bore 86) above the closed valve closure means 102, the pressure of such residual well fluids will generally be low when compared with the presence of well fluids below valve closure means 102.

To open the flow path through the subsurface safety valve 26, control fluid within control conduit means 32 is pressurized at the surface by operating manifold 34. The pressurized control fluid is effective upon the pressure responsive means within pilot valve means 36. When the fluid is pressurized a sufficient amount, (e.g., when the control fluid pressure force acting across seal means 82 is greater than the sum of the residual well fluid pressure force also acting across seal means 82 and the force of spring means 96) the pressure responsive means moves pilot valve member means 78 downward from its first position (See FIG. 3) to its second position (See FIG. 6). Until seal means 82 leaves the first seal bore means 84, the pressure responsive means comprises the one valve means of pilot valve means 36. Once seal means 82 has left the first seal bore means 84, the pressure responsive means comprises the other valve means of pilot valve means 36. Regardless of which valve means comprises the pressure responsive means, the pressure effective areas (e.g., across either seal means 82 or 94) are relatively small and the force of spring means 96 may be relatively large. Fluid pressure of an amount sufficient to create a relatively large pressure differential across either seal means 82 or 94 will move and hold pilot valve member means 78 in its second position (See FIG. 6). However, prior to opening the subsurface flow path, a fluid pressure sufficient to move pilot valve member means 78 to its second position will most likely be less than the pressure of well fluids below valve closure means 102.

With pilot valve means in its second operative position, pressurized fluid from control conduit means 32 communicates to the subsurface safety valve 26 and enters its control pressure chamber means 122. The control fluid is pressurized by operating manifold 34 until the pressure within control pressure chamber means 122 obtains at least a minimal amount which moves operator means 108 downward to its second position. The minimal control fluid pressure which moves operator means 108 downwardly will be greater than the pressure of well fluids below valve closure means 102. Downward movement of operator means 108, results in valve closure means 102 pivoting to its second position opening the subsurface flow path 106 (See FIGS. 7A and 7B).

After the subsurface flow path is opened, well fluid pressure from the producing formation (not shown) will be present in the housing bore 106 and side pocket mandrel bore 86. The net well fluid pressure force (e.g. the product of well fluid pressure times the difference between the second seal effective area of seal means 126 and the first seal effective area of seal means 124) tends to move operator means 108 to its first position. Since pressurized control fluid within control pressure chamber means 122 is effecitve across a differential piston area also equal to the difference between the second seal effective are and the first seal effective area, the minimal control fluid pressure which maintains operator means 108 in its second position is greater than the well fluid pressure. Additionally, the pressure of well fluids within the side pocket mandrel bore 86 will act across the second seal means 94 carried on pilot valve member means 78. A well fluid pressure force will be produced tending to move pilot valve member means 78 to its first position. Thus, the sufficient amount of control fluid pressure which maintains pilot valve means 36 in its second operative position is also greater than well fluid pressure.

The flow path 106 through the subsurface safety valve 26 will remain open as long as control pressure chamber means 122 of the subsurface safety valve 26 is pressurized that minimal amount greater than well fluid pressure. That minimal amount of pressure will be effective within control pressure chamber means 122 as long as there is a sufficient amount of pressure, also greater than well fluid pressure, within pilot valve means 36 to maintain pilot valve member means 78 in its second position (See FIG. 6).

If for any reason, such as a loss of pressure at the surface, a severance of control conduit means 32, or a controlled reduction in pressure in control conduit means 32 by operating manifold 34, the pressure of control fluid within control conduit means 32 decreases below the amount sufficient to produce a force greater than the force produced by spring means 96 and well fluid pressure, pilot valve member means 78 will be moved from its second position shown in FIG. 6 to its first position shown in FIG. 3. Because of the small effective area of the pilot valve's pressure responsive means (e.g., the area across either seal means 84 or seal means 94) and because of the short stroke of pilot valve member means 78, only a small volume of control fluid will be displaced into control conduit means 32. Therefore, the means 96 for biasing pilot valve member means 78 to its first position will be capable of quickly moving pilot valve member means 78 to that position whenever the control fluid pressure drops below the sufficient amount. Even though a relatively large hydrostatic head of fluid within control conduit means 32 produces a large hydrostatic pressure force, even though that same head of fluid has a relatively large inertia, and even though during movement of that fluid friction will develop between the fluid and the walls of control conduit means 32, the combined forces resisting movement of control fluid into control conduit means 32 will, at pilot valve means 36, be effective over a very small area. The forces resisting movement of pilot valve member means 78 will therefore also be small. Those forces can be overcome by spring means 96 to displace a small volume of control fluid into control conduit means and move pilot valve member means 78 to its first position.

After pilot valve means 36 has returned to its first operative position (See FIG. 3), continued communication of pressurized control fluid between control conduit means 32 and the subsurface safety valve 26 is prevented. Additionally, the passageway means is opened. Therefore, control fluid within the safety valve's control pressure chamber means 122, which has been pressurized to an amount above well fluid pressure, quickly falls to at least approximate well fluid pressure. Even though control fluid will remain in that portion 32*a* of the conduit extending between the side pocket mandrel and the subsurface safety valve 26, the combined fluid forces of the fluid should not be able to keep the safety valve 26 open. In fact, the shorter the distance between the side pocket mandrel 40 and the landing nipple 42, the smaller will be the combined fluid forces resisting closure of the subsurface safety valve 26.

In addition, due to the now permitted fluid communication between control pressure chamber means 122 and the flow path through the side pocket mandrel bore 86, operator means 108 becomes at least substantially pressure balanced. Well fluid pressure acts downwardlly upon operator means 108 across the first seal effective area of first seal means 124. Fluid within control pressure chamber means 122, which is at substantially the same pressure as well fluid pressure, also acts downwardly upon operator means 108 but across the differential area between the second seal means 126 and the first seal means 124. Well fluid pressure also acts upwardly upon operator means 108 across the second seal effective area of seal means 126. As a result, the fluid forces upon operator means 108 are substantially balanced. With operator means 108, fluid pressure balanced, the energy stored by spring means 116 is more easily capable of producing a force to push operator means 108 upwardly and displace control fluid from within control pressure chamber means 122. Because only a small force resists spring means 116, it quickly moves operator means 108 upwardly to its first position. The flow path through the subsurface safety valve 26 is thereby quickly closed.

Figure 8:
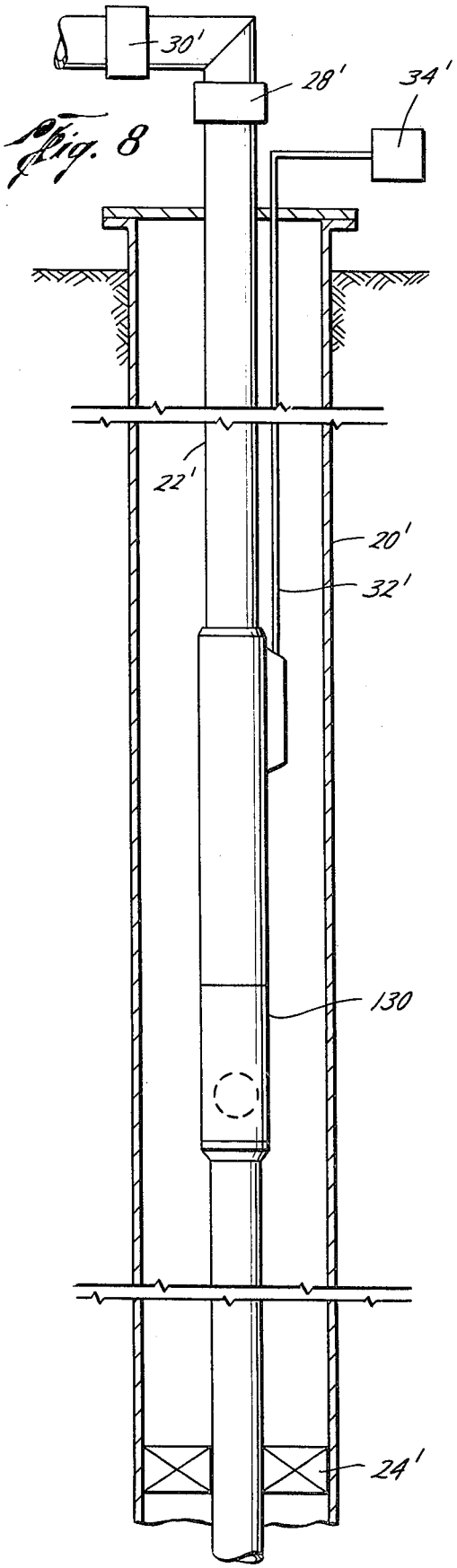
FIG. 8 is a schematic illustration of another well installation in accordance with other embodiments of this invention.
Figure 2A:
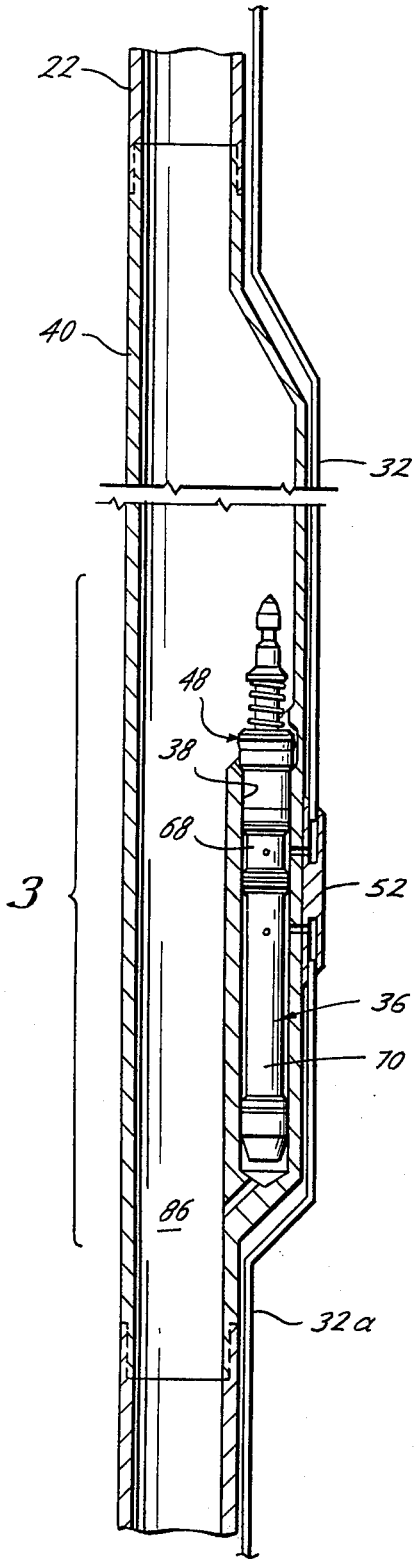
FIGS. 2A and 2B are continuation views, partly in section and partly in elevation, illustrating further detail of the well installation shown in FIG. 1.
Figure 2B:
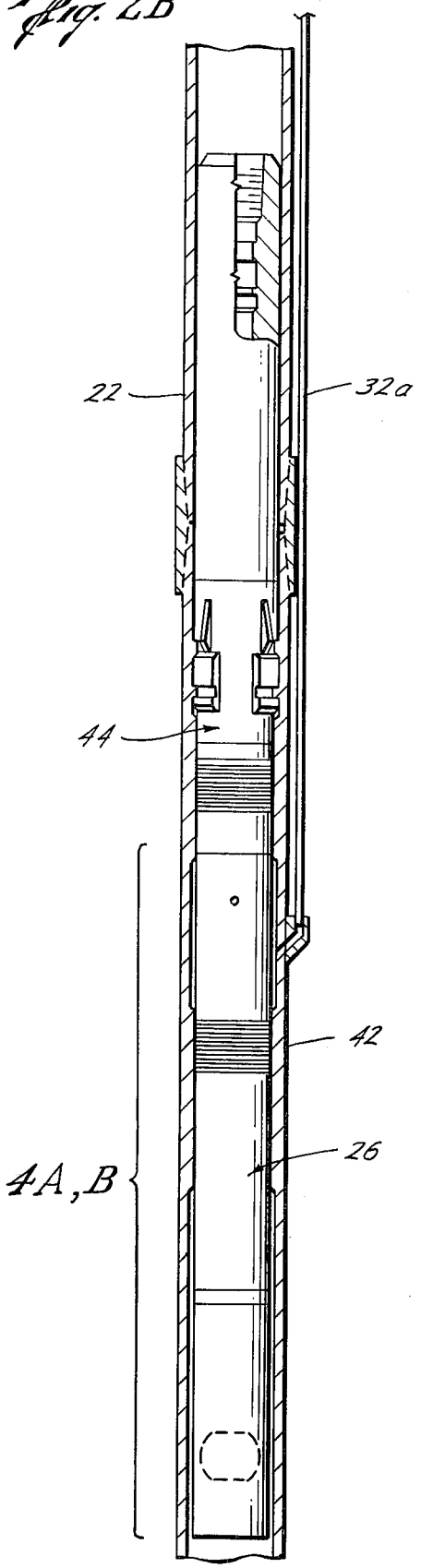

FIG. 8 illustrates a modified well installation useable with this invention. This well installation also has a casing 20' through which extends a tubing string 22'. The annulus between the casing string 20' and tubing string 22' is packed off by packer means 24' to define a flow path through the tubing string 22'. Surface valves 28' and 30' control flow through the tubing string at the well head. At a subsurface location in the tubing string 22' is positioned a subsurface safety valve 130 for controlling flow through the subsurface flow path. The subsurface safety valve 130 is controlled from the surface by communicating control fluid between the surface and the subsurface safety valve through control conduit means 32'. The operating manifold 34' selectively pressurizes and depressurizes the control fluid within control conduit means 32'.

FIGS. 9A and 9B, 10A and 10B, and 11 illustrate one form of a subsurface safety valve for the well installation of FIG. 8. The illustrated subsurface safety valve 130 is a tubing retrievable, surface controlled tubing safety valve. The subsurface safety valve 130 includes valve housing means 132, valve closure means 134 and means for moving valve closure means 134 between its positions opening and closing the subsurface flow path.

Valve housing means, generally indicated at 132, includes interconnected tubular sections 132*a*, 132*b* and 132*c* and defines the subsurface flow path with its bore 136.

Valve closure means 134 is associated with valve housing means 132 and opens and closes the bore 136.

Operator means 138, including sections 138*a* and 138*b*, is movable within the bore 136 and moves valve closure means 134. A first, upward position of operator means 138 has valve closure means 134 in its first bore closing position (See FIGS. 9A and 9B0. A second downward position of the operator means maintains valve closure 134 in its second bore opening position (See FIGS. 10A and 10B).

Means 140 for resiliently urging operator means 138 to its first upward position is provided by spring means 140.

Being a surface controlled subsurface safety valve, the safety valve 130 includes means responsive to control pressure, including control pressure chamber means 142, for moving operator means 138 to its second position to open the flow path through the bore 136.

Control pressure chamber means 142 is defined, in part, by first and second seal means 143 and 145, respectively, which seal between operator means 138 and valve housing means 132. Fluids within the housing bore 136 act across the first seal effective area of first seal means 143 and produce a force tending to move operator means 138 to its second position. Fluids within control pressure chamber means 142 act across its differential piston area between the first and second seal means 143 and 145 and produce a force tending to move operator means 138 to its second position. Fluids within the housing bore 136 also communicate through port means 151, act across the second seal effective area of second seal means 145, and produce a force tending to move operator means to its first position. Because of these fluid forces acting upon operator means 138, the minimal pressure of control fluid which will move and maintain operator means 138 in its second position is a pressure which is greater than the pressure of well fluids within the housing bore 136.

The subsurface safety valve 130 also includes means for controllably pressurizing control pressure chamber means 142. This means includes pilot valve means, generally indicated at 144, in close proximity to control pressure chamber means 142. Pilot valve means 144 controls the passage of pressurized control fluid between control conduit means 32' and control pressure chamber means 142. Pilot valve means 144 also enables a substantial pressure balancing of operator means 138 and the displacement of control fluid from within control pressure chamber means 142 with reduced force resistance.

To communicate control fluid between control conduit means 32' and control pressure chamber means 142, connector means 146 is attached to valve housing means 132 adjacent to control pressure chamber means 142. Connector means 146 also functions as pilot valve housing means and has formed therein a valved fluid passage means communicating between control conduit means 32' and control pressure chamber means 142. Connector means includes port means 148 having a thread 148*a* in which is received the lower end of control means 32'. Pilot valve chamber means 150 is formed within pilot valve housing means 146 and communicates with port means 148. Communicating between pilot valve chamber means 150 and control pressure chamber means 142 is a passage means including control port means 152 extending through valve housing means 132 and side port means 154 in pilot valve housing means 146.

For enabling a substantial pressure balancing of operator means 138, valved passageway means 156 extends between pilot valve chamber means 150 and the bore 136 of the subsurface safety valve 130.

Pilot valve member means 78' is disposed within pilot valve chamber means 150. Pilot valve member means 78' with its two valve head means 80' and 92' is the same as pilot valve member means 78 previously described. Its corresponding elements have been designated with corresponding numerals except for the addition of *a* '.

Likewise the means 96' for resiliently biasing pilot valve member means 78' is the same as previously described. It also has a corresponding numeral designation except for a '.

Port means 148 forms a first seal bore means 148. Seal bore means 148 is sized to be in sealing contact with seal means 82' carried by the one pilot valve head means 80' when that one pilot valve head means 80' is disposed therein (see FIG. 9A). A second seal bore means 158 is formed at the junction of passageway means 156 and pilot valve chamber means 150. Second seal bore means 158 is also sized to be in sealing contact with seal means 94' carried by the other valve head means 92' when it is disposed therein (see FIG. 10A).

A two-way valve means is thus provided by pilot valve means 144. In a first operative position of pilot valve means 144 (See FIG. 9A) fluid communication is prevented, by the one valve means, between control conduit means 34' and control pressure chamber means 142. Additionally, fluid communication is permitted, by the other valve means, between control pressure chamber means 142 and the bore 136. In a second operative position of pilot valve means 144 (See FIG. 10A), fluid communication between control conduit means 32' and control pressure chamber means 142 is permitted while fluid communication between control pressure chamber means 142 and the bore 136 is prevented. Such two-way valve action is obtained by controlling flow between side port means 154 of the passage means and a selected one of port means 148 and passageway means 156.

The pressure responsive means for moving pilot valve member means 78' to its second position is affected by fluid within cntrol conduit means 32' and by fluid within the bore 136. Fluids from both regions act across the same area (e.g., across seal means 82' or 94' depending upon the operative position of pilot valve means 144). Therefore, to move pilot valve member means 78' to its second position, fluid within control conduit means 32' is pressurized to an amount sufficient to produce a force greater than the sum of the well fluid pressure force acting upon pilot valve member means 78' and the force of spring means 96'.

In operation, this form of a pilot valve controlled subsurface safety valve controls flow through the well at a subsurface location.

The tubing string 22' is run with the tubing removable subsurface safety valve 130 positioned therein. Control conduit means 32' would extend between the subsurface safety valve 130 and the operating manifold 34' on the surface.

Prior to a buildup of pressurized control fluid within control conduit means 32', pilot valve means 144 is in its first operative position. Spring means 96' holds pilot valve member means 78' in its first upward position blocking fluid flow between port means 148 and side port means 154. Likewise, valve closure means 134 of the subsurface safety valve 130 is maintained in its first position closing the subsurface flow path through the bore 136 by spring means 140.

When it is desired to open the subsurface safety valve 130, operating manifold 34' increases the pressure of control fluid within control conduit means 32'.

The pressurized control fluid is first effective upon pressure resonsive means within pilot valve means 144. This pressure responsive means first includes the one pilot valve head means 80' and seal means 82'. When control fluid at port means 148 is pressurized a sufficient amount, the control fluid pressure times the effective area of the pressure responsive means produces a force which overcomes the force of spring means 96' and the force of any residual well fluids within the bore 136 above valve closure means 134. The produced control fluid pressure force pushes pilot valve member means 78' downwardly. Prior to the time seal means 82' leaves seal bore means 148, seal means 94' enters seal bore means 158. After seal means 82' has left seal bore means 148, the pressure responsive means includes the other pilot valve head means 92' and seal means 94'.

With pilot valve member means 78' moved to its second position (See FIG. 10A), fluid communication between control conduit means 32' and control pressure chamber means 142 is permitted while control fluid loss through passageway means 156 is prevented.

Operating manifold 34' continues to increase the pressure of control fluid within control conduit means 32'.

When a certain minimal amount of pressure is developed within control pressure chamber means 142, which pressure will be greater than the well fluid pressure below valve closure means 134, the pressurized control fluid produces a force acting upon operator means 138 which is stronger than the sum of the forces generated by spring means 140 and by downhole well fluids. Operator means 138 is moved by this control fluid pressure force to its second, downward position. Valve closure means 134 is thereby moved to its position opening the subsurface flow path through bore 136.

After valve closure means 134 has moved to its second position, the pressure of flowing well fluids will act upon pilot valve member means 78' and operator means 138. To both maintain pilot valve means 144 in its second operative position (See FIG. 10A) and valve closure means 134 in its bore opening position (See FIG. 10B), control fluid within pilot valve chamber means 150 must remain pressurized a sufficient amount, which amount is greater than well fluid pressure in bore 136, and control fluid within control pressure chamber means must remain pressurized a minimal amount, which amount is also greater than well fluid pressure in bore 136.

Figure 9A:
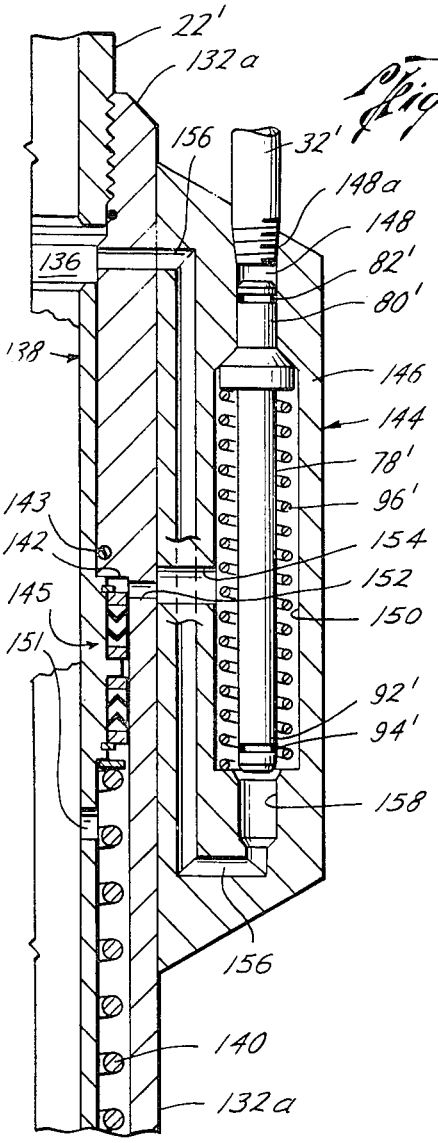
FIGS. 9A and 9B are continuation views, partly in section and partly in elevation, of one embodiment of a pilot valve and subsurface safety valve as utilized in the well installation of FIG. 8 with both the pilot valve and safety valve closed.
Figure 10A:
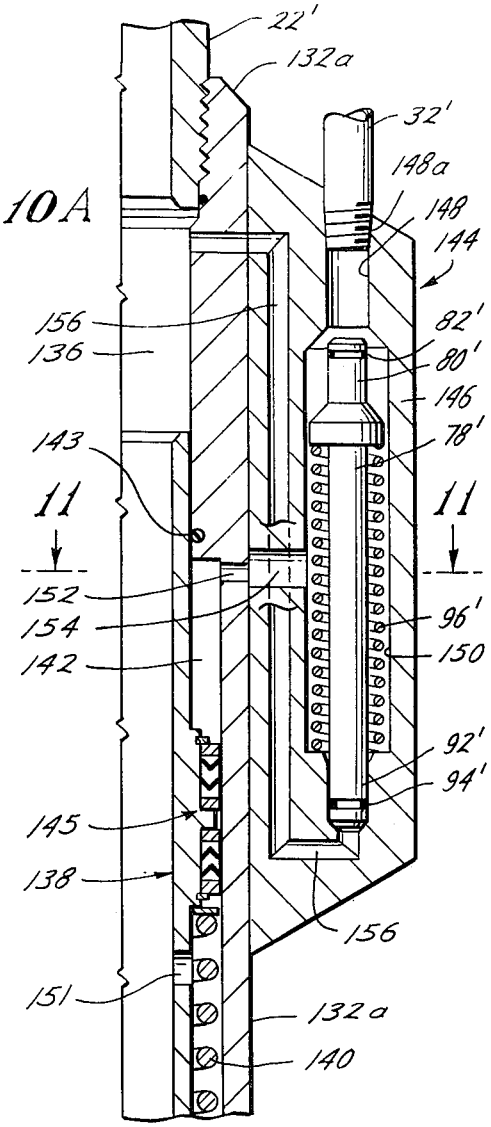
FIGS. 10A and 10B are continuation views, partly in section and partly in elevation, of the pilot valve and safety valve of FIGS. 9A and 9B with both the pilot valve and safety valve open.
Figure 11:
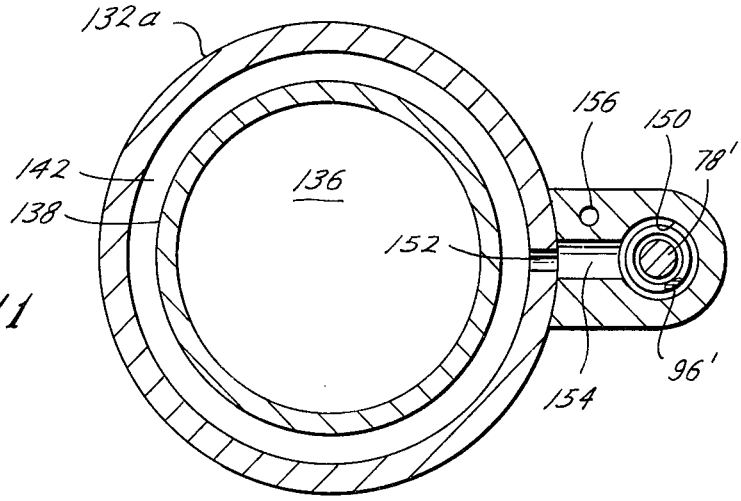
FIG. 11 is a cross-sectional view taken along line 11—11 of FIG. 10A.
Figure 9B:
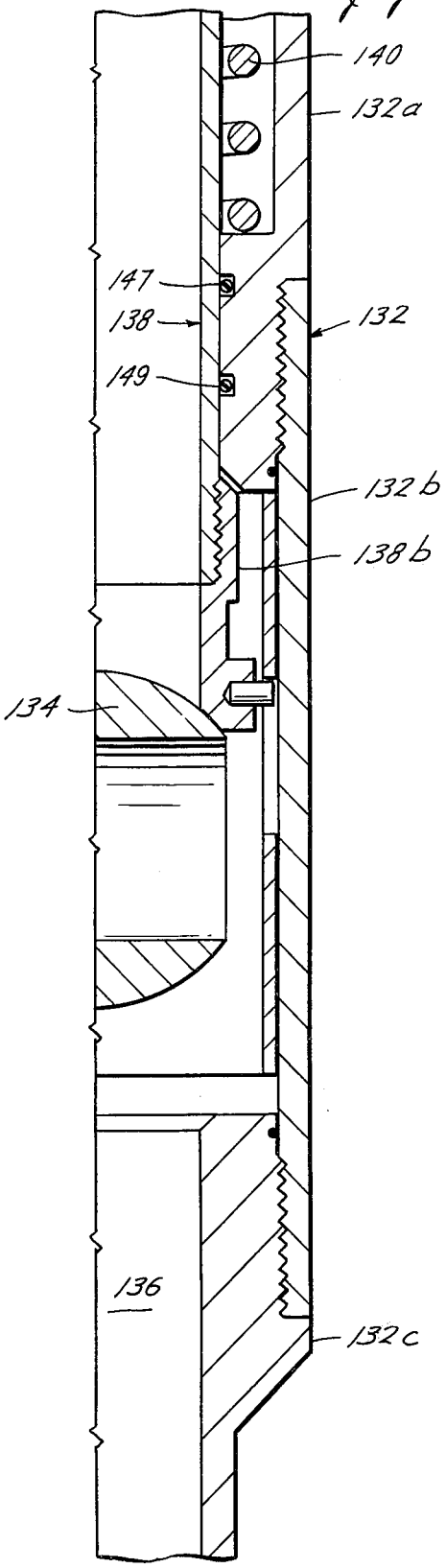
Figure 10B:
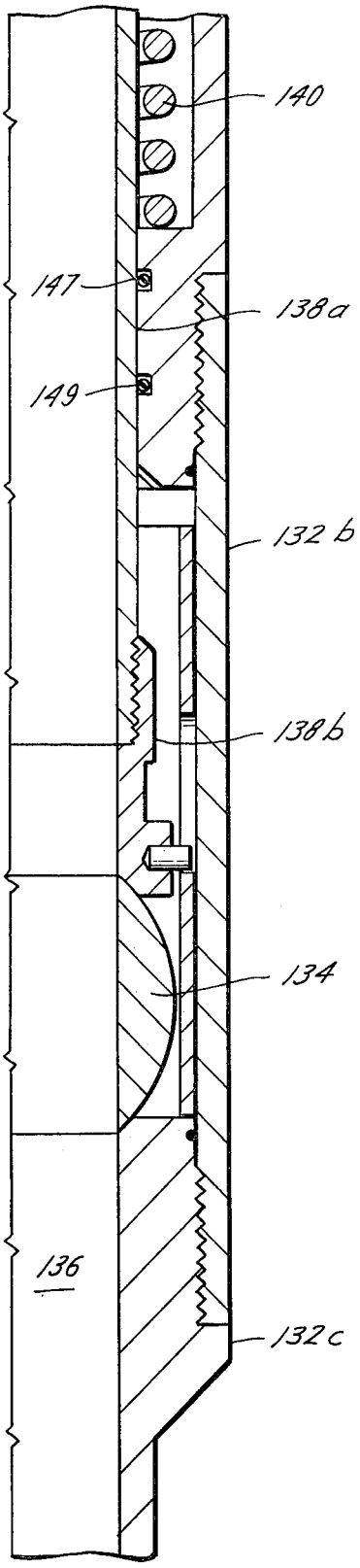

Upon a reduction of control fluid pressure within pilot valve chamber means 150 to an amount below that sufficient amount, for whatever reason, spring means 96' will move pilot valve member means 78' to its first position (See FIG. 9A). Since (as can be seen in FIG. 11) the effective area of the pressure responsive means of pilot valve means 144 (e.g., the cross-sectional area of pilot valve member means 78') is much less than the effective area of the means responsive to control pressure of the subsurface safety valve 130 (e.g., the cross-sectional area of control pressure chamber means 142) the force due to control fluid exerted on pilot valve member means 78' is much less than the force due to control fluid exerted on operator means 138. Therefore, spring means 96' can exert a relatively small force upon pilot valve member means 78' and still move pilot valve member means 78' upwardly. Additionally, since pilot valve member means 78' is moved through a relatively short stroke, and since the volume defined by seal bore means 148 is small, very little pressurized control fluid is displaced during the movement of pilot valve member means from its second position shown in FIG. 10A to its first position shown in FIG. 9A.

Movement of pilot valve member means 78' upwardly to its first position returns the pilot valve means 144 to its first operative position. Thereafter the one valve means of pilot valve means 144 prevents control fluid flow between control conduit means 32' and the subsurface safety valve's control pressure chamber means 142. Additionally, the other valve means of pilot valve means 144 permits fluid communication between the safety valve's control pressure chamber means 142 and the bore 136 through passageway means 156. Such fluid communication substantially pressure balances the safety valve's means responsive to control pressure. Prior to movement of pilot valve means 144 to its first operative position, flowing well fluids exert pressure forces upon operator means 138 across first seal means 143 and across second seal means 145. After movement of pilot valve means 144 to its first operative position, but prior to movement of valve closure means 134 to its first bore closing position, the pressure of fluid within control pressure chamber means 142 reduces to the pressure of the flowing well fluids. Therefore, the pressure of flowing well fluids is also effective across the differential piston area of control pressure chamber means 142. Operator means 138, and the safety valve's means responsive to control pressure, is substantially pressure balanced as it is affected by substantially one fluid pressure.

The combined effects of preventing flow between control conduit means 32' and control pressure chamber means 142 and of substantially pressure balancing operator means 138 enables quick closure of the subsurface safety valve 130. The forces due to the hydrostatic head of control fluid within control conduit means 32' are not applied to fluid within control pressure chamber means 142. Fluid within control pressure chamber means 142 may be easily displaced into the bore 136. It can be appreciated that a force which will displace fluid from control pressure chamber means 142 through passageway means 156 to bore 136 is much less than the force that would be required to displace that same volume of fluid against fluid forces due to the hydrostatic head of control fluid within a control conduit extending to the surface. Therefore, spring means 140 is able to quickly move operator means 138 upwardly. Valve closure means 134 is also quickly moved to its position closing the flow path through bore 136 (See FIG. 9B).

Figure 12:
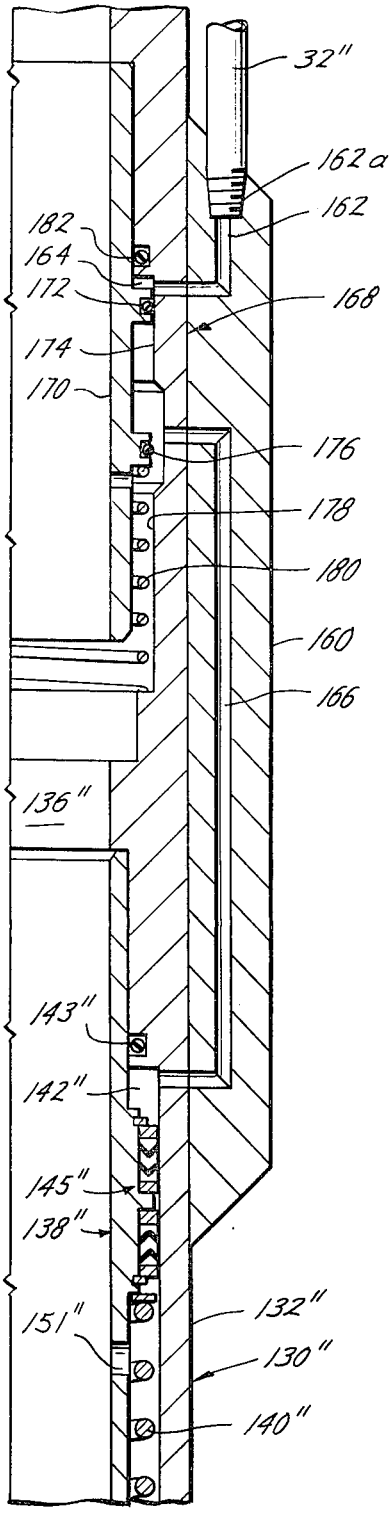
FIG. 12 is a view, partly in section and partly in elevation, of another embodiment of a pilot valve useable with the well installation of FIG. 8 with the pilot valve closed.
Figure 13:
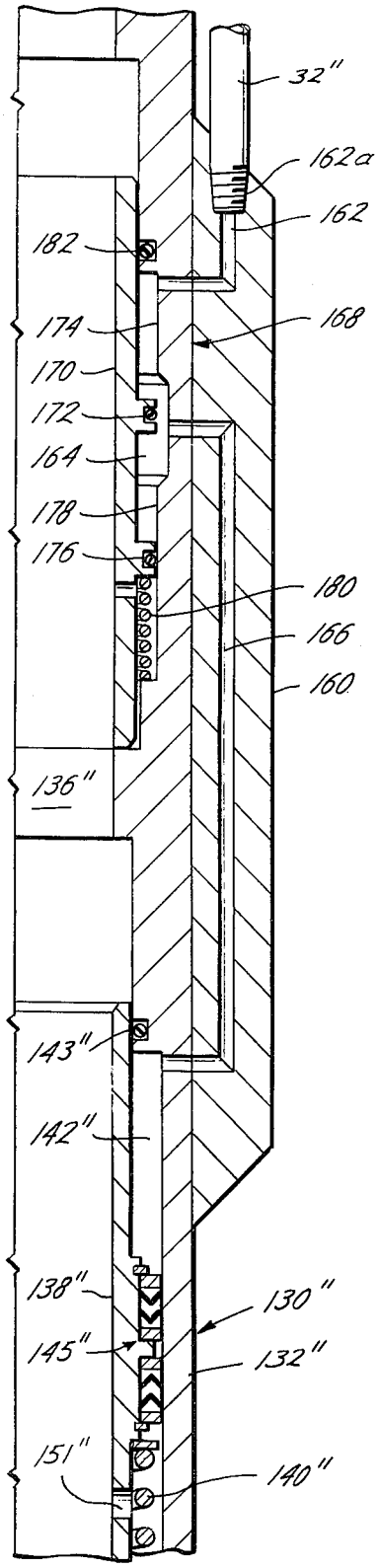
FIG. 13 is a view, partly in section and partly in elevation, of the pilot valve of FIG. 12 with the pilot valve open.

FIGS. 12 and 13 are a partial view of another form of this invention useable with the well installation of FIG. 8. FIGS. 12 and 13 illustrate the upper portion of a subsurface safety valve and the associated pilot valve means. The lower portion of the subsurface safety valve may be the same as the portion illustrated in FIGS. 9B and 10B. Elements of this embodiment which correspond to elements previously disclosed are designated with corresponding numerals except for the addition of *a* ".

Pressurized control fluid communicates between control conduit means 32" and the subsurface safety valve 130" through connector means 160 attached to valve housing means 132" adjacent to control pressure chamber means 142". Connector means 160 includes port means 162 having a thread **162*a* therein. The thread 162*a* receives the lower end of control conduit means 32". Port means 162 communicates between control conduit means 32" and valved pilot valve chamber means 164. Extending between the valved pilot valve chamber means 164 and control pressure chamber means 142" is passage means 166. The valve of pilot valve means controls the flow of pressurized control fluid between control conduit means 32" and control pressure chamber means 142" through passage means 166**.

Pilot valve housing means 168 comprises an extension on valve housing means 132" and, as illustrated, extends above the upper end of operator means 138".

Valve means for controlling flow through pilot valve means includes sleeve pilot valve member means 170 which is axially movable within pilot valve housing means 168. Pilot valve chamber means 164 is formed between sleeve valve means 170 and pilot valve housing means 168. One valve means for pilot valve means includes first seal means 172 carried on sleeve valve member means 170 for sealing between sleeve valve member means 170 and a first annular seal bore means 174 which is formed within pilot valve housing means 168. Pilot valve means also includes second seal means 176 carried on sleeve valve member means 170 and spaced from the first seal means 172. Second seal means seals between sleeve valve means 170 and a second annular seal bore means 178 which is formed within pilot valve housing means 168 and is spaced from the first seal bore means 174. Port means 162 opens into pilot valve chamber means in spaced relation to where passage means 166 opens into pilot valve chamber means 164. Passage means 166 opens into pilot valve chamber means 164 between the two spaced annular seal bore means 174 and 178 so that flow therethrough may be controlled depending upon which one of the two spaced seal means 172 and 176 is engaging the respective annular seal bore means 174 and 178. Port means 162 opens into pilot valve chamber means 164 at one extremity of the first annular seal bore means 174 where the first seal means 172 may be effective to prevent flow between said port means 162 and said passage means 166.

When pilot valve member means 170 is in its first position (See FIG. 12), the one valve means prevents fluid flow between control conduit means and control pressure chamber means 142" by preventing flow between port means 162 and passage means 166. At the same time, the other seal means 176 does not engage the second annular seal bore means 178. Fluid may communicate between control pressure chamber means 142" and bore 136" through passage means 166 and pilot valve chamber means 164 to enable substantial pressure balancing of operator means 138".

As pilot valve member means 170 moves downwardly, the second seal means 176 engages the second annular seal bore means 178 before the first seal means 172 disengages from the first annular seal bore means 174. The second valve means of pilot valve means thereby prevents a loss of control fluid from control conduit means 32". Instead, after pilot valve member means 170 has been moved downwardly sufficiently so that the first seal means 172 no longer engages annular seal bore means 174, control fluid from control conduit means 32" passes through passage means 166 and becomes effective within control pressure chamber means 142" of the subsurface safety valve 130".

The pilot valve means additionally includes means 180 for resiliently biasing the sleeve pilot valve member means 170 to its first position shown in FIG. 12. Such means 180 may be spring means 180.

For moving sleeve pilot valve member means 170 from the position illustrated in FIG. 12 to the position illustrated in FIG. 13, pilot valve means includes pressure responsive means. The pressure responsive means includes pilot valve chamber means 164. Pressurized fluid within pilot valve chamber means 164 is effective across the first seal means 172 when it sealingly engages the first annular seal bore means 174 and is effective across the second seal means 176 when the first seal means 172 no longer engages the first annular seal bore means 174.

Preferably, the volume of pilot valve chamber means 164 is maintained as small as possible so that pilot valve means can be as sensitive as possible to decreases in the pressure of control fluid within pilot valve chamber means 164. The volume is kept to a minimum by keeping to a minimum both the amount of stroke (e.g., axial movement) of sleeve pilot valve member means 170 and the differential area of the pressure responsive means.

The operation of this embodiment of the invention is similar to the previously described operations of other embodiments.

Prior to the pressurization of control fluid within control conduit means 32", the pilot valve means is in its first operative position due to spring means 180 maintaining sleeve pilot valve member means 170 in the position shown in FIG. 12. Control fluid is prevented from communicating between control conduit means 32" and the subsurface safety valve's control pressure chamber means 142". With no pressurized control fluid within control pressure chamber means 142", spring means 140" of the subsurface safety valve 130" maintains valve closure means in a position closing the subsurface flow path through bore 136".

The subsurface safety valve 130" is opened by increasing the pressure of control fluid within control conduit means 32". When the pressure of control fluid at port means 162, and therefore within pilot valve chamber means 164, reaches a sufficient amount, the pressure responsive means of pilot valve means moves sleeve pilot valve member means 170 downwardly. The pressure of the control fluid which initially will be sufficient to move sleeve pilot valve member means 170 to its second position generally will be less than the pressure of shut-in well fluids below the valve closure means. The pressurized control fluid within pilot valve chamber means 164 is first effective across the first seal means 172. It remains effective across seal means 172 as long as seal means 172 sealingly engages the first annular seal bore means 174. When the first seal means 172 disengages from the first annular seal bore means 174, the pressurized fluid within the pilot valve chamber means 164 becomes effective across the second seal means 176 which is by now in sealing engagement with the second annular seal bore means 178. In this manner, there is always an effective pressure responsive means for the pilot valve means and pressurized control fluid is prevented from being disipated into bore 136".

When the pressurized control fluid has moved sleeve pilot valve member means 170 downwardly so that first seal means 172 no longer sealingly engages the first annular seal bore means 174, pressurized control fluid communicates between control conduit means 32" and control pressure chamber means 142" through passage means 166.

The pressure of control fluid within control pressure chamber means 142'' increases. When the pressure within control pressure chamber means 142'' reaches a minimal amount, valve closure means is moved to its position opening the subsurface flow path. The minimal amount of control fluid pressure which will move operator means 138'' to its second position will be greater than the pressure of shut-in well fluids. After the subsurface flow path is opened, the minimal amount of control fluid pressure which will maintain operator means in its second position is greater than the pressure of flowing well fluids. (The net well fluid force is equal to the product of the pressure of the flowing well fluids times the difference between the second seal effective area of seal means 145'' and the first seal effective area of seal means 143''. The control fluid force, which overcomes the well fluid force, is equal to the product of the control fluid pressure times the differential piston area between seal means 145'' and 143''.) Additionally, the control fluid pressure which is sufficient to maintain pilot valve means in its second operative position is also greater than the pressure of flowing well fluids. (Well fluids and control fluid both act across the same differential area defined by seal means 176 and 182, but each acts in a different direction.)

Whenever the pressure of control fluid within control conduit means 32'' is reduced below that sufficient amount, for whatever reason, spring means 180 moves sleeve pilot valve member means 170 upwardly. Pilot valve means is thereby returned to its first operative position. Even though control fluid within pilot valve chamber means 164 is displaced against the fluid forces due to the hydrostatic head of control fluid in control conduit means 32'', the volume displaced is small because of the minimized stroke of pilot valve member means 170 and the minimized differential area of its pressure responsive means. Sometime during the movement of pilot valve member means 170 to its first position, seal means 172 re-engages seal bore means 174. Control fluid is thereby prevented from communicating between control conduit means 32'' and the safety valve's control pressure chamber means 142''. (See FIG. 12). Also during this movement of pilot valve member means 170, second seal means 176 will disengage from the second annular seal bore means 178. At that time control fluid within pilot valve chamber means 164 will be in fluid communication with the bore 136''. Control fluid within control pressure chamber means 142'' will also be in fluid communication with the bore 136'' through passage means 166. Placing the control pressure chamber means 142'' in fluid communication with the bore 136'' substantially pressure balances the means responsive to control pressure of the subsurface safety valve 130''. With the pressure of well fluids within the bore 136'' effective within control pressure chamber means 142'', well fluids act downwardly upon operator means 138'' across the effective area of seal means 143'' and the control piston area between seal means 143'' and seal means 145''. Well fluid pressure above the valve closure means in the bore 136'' communicates through port means 151'' and acts upwardly upon operator means 138'' across the effective area of seal means 145''. Since the downward and upward pressure effective areas are equal and since the substantially same well fluid pressure acts upon these areas, operator means 138'' becomes substantially fluid pressure balanced. Fluid pressure balancing operator means 138'' enables quick closure of the subsurface safety valve 130''. A relatively small force, when compared with the force that has been required to move an operator upwardly against the fluid forces due to hydrostatic head of fluid within the control conduit, may move operator means 138'' upwardly. Spring means 140'' may easily store the energy to produce this relatively small force. Spring means 140'' can therefore quickly move operator means 138'' upwardly to the position shown in FIG. 12 wherein the subsurface safety valve 130'' closes the subsurface flow path.

Figure 14:
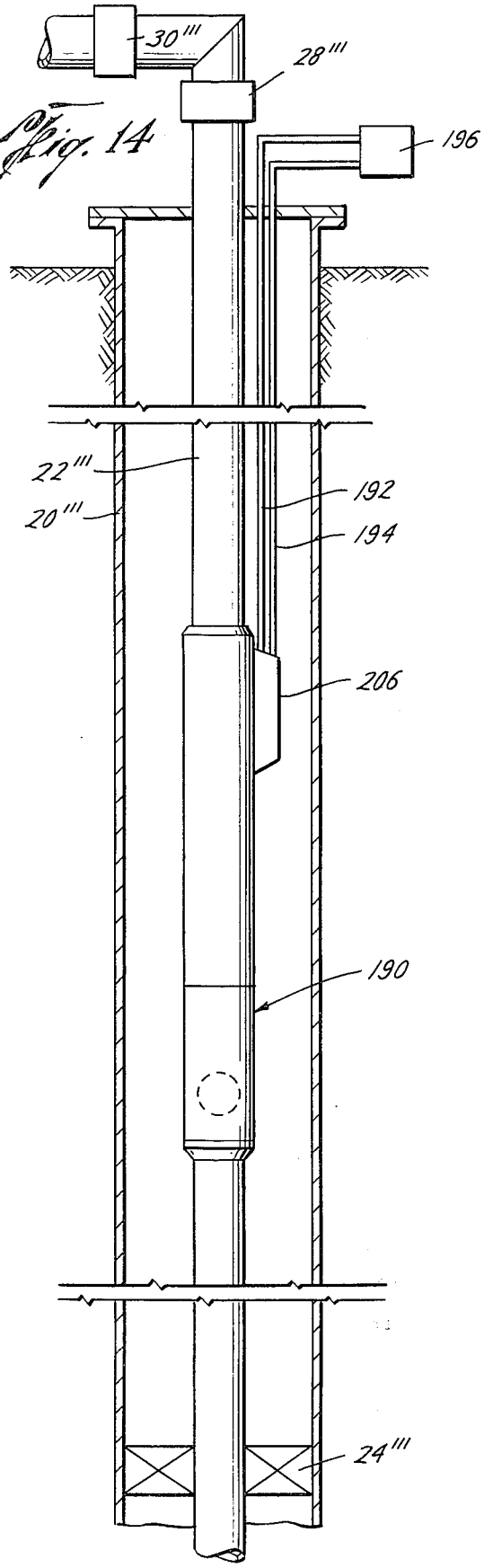
FIG. 14 is a schematic illustration of another well installation in accordance with another embodiment of this invention.

FIG. 14 illustrates another well installation utilizing another embodiment of this invention. Again, the well is cased at 20''' and includes a tubing string 22''' extending therethrough. The annulus between tubing string 22''' and casing 20''' is packed off by packer means 24''' to define a flow path through the tubing string 22''' from the producing formation (not shown). At the well head, surface valves 28''' and 30''' control flow through the tubing string 22'''. At a subsurface location, safety valve 190 controls flow through the subsurface flow path. To control the safety valve 190 from the surface, dual conduit means, one being control conduit means 192 and the other being balance conduit means 194, extend between the safety valve 190 and operating manifold 196.

Figure 17:
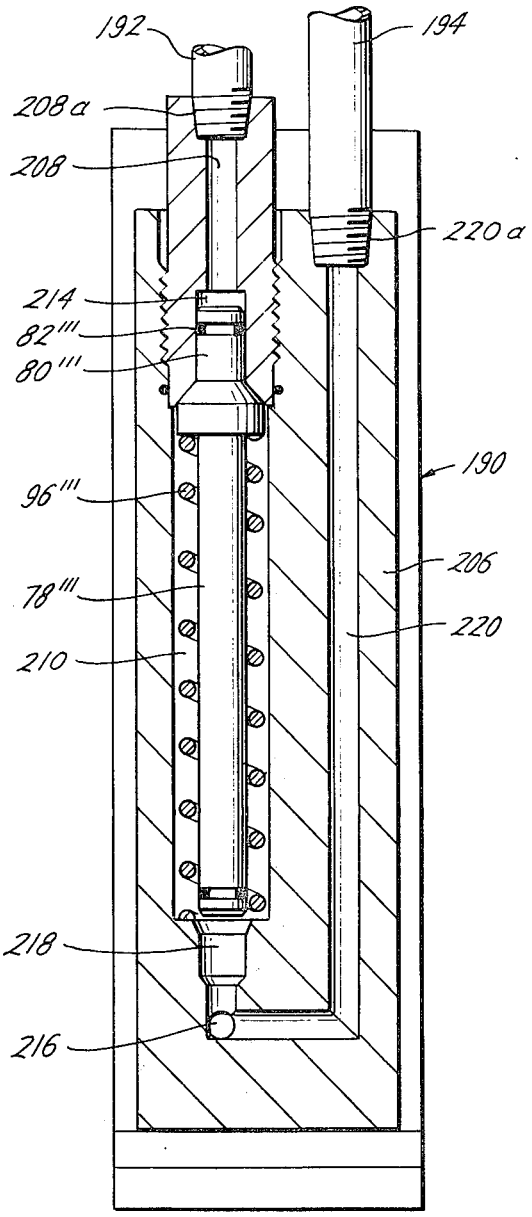
FIG. 17 is a view, partly in section and partly in elevation, of the pilot valve of FIG. 15 taken along line 17—17.
Figure 15:
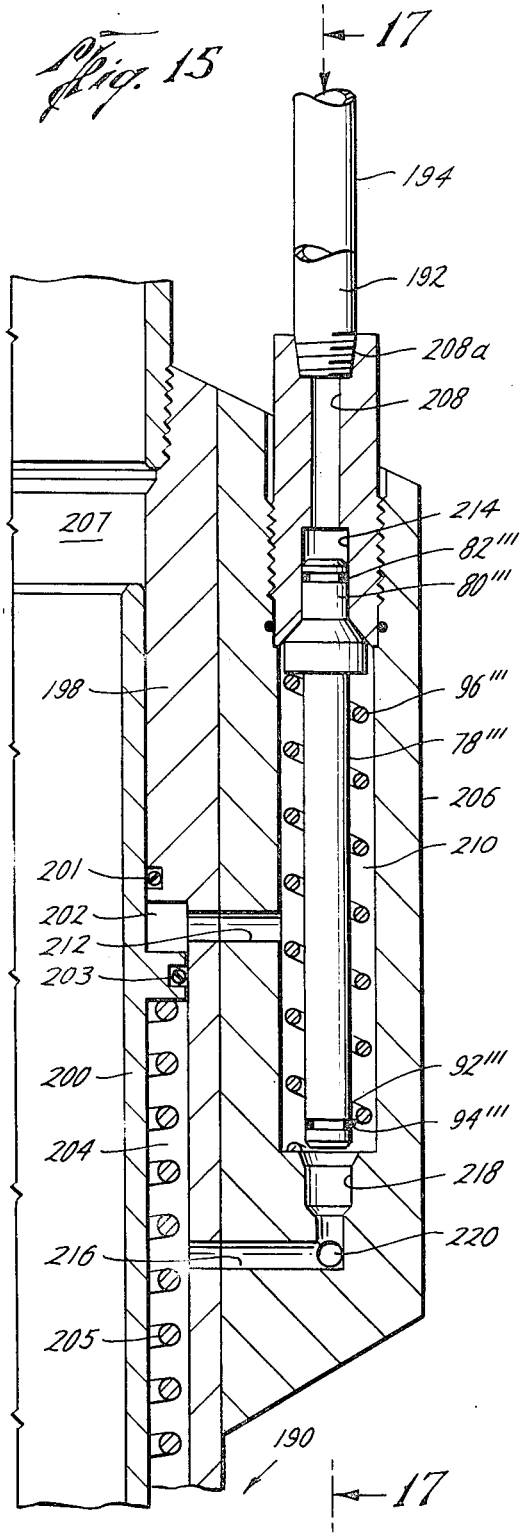
FIG. 15 is a view, partly in section and partly in elevation, of another form of a pilot valve useable in the well installation of FIG. 14 with the pilot valve closed.
Figure 16:
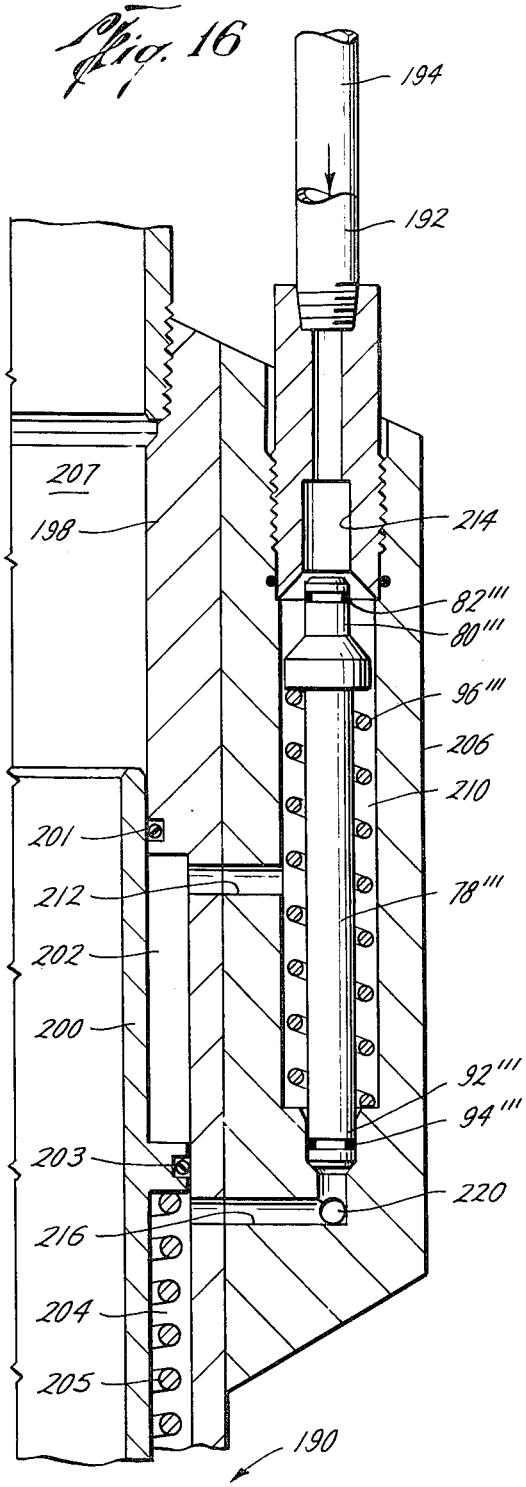
FIG. 16 is a view, partly in section and partly in elevation, of the pilot valve of FIG. 15 with the pilot valve open.

FIGS. 15, 16 and 17 are a partial view of a portion of the subsurface safety valve 190 with the associated pilot valve means. The lower portion of the subsurface safety valve 190 may be the same as the lower portion of the subsurface safety valve 130 illustrated in FIGS. 9B and 10B. FIGS. 15 and 16 illustrate the upper portion of the valve housing means 198 and operator means 200.

Like previously described subsurface safety valves, the subsurface safety valve 190 includes control pressure chamber means 202 which is pressurized to move operator means 200 downwardly. Additionally, however, the subsurface safety valve 190 also includes balance pressure chamber means 204 formed between operator means 200 and valve housing means 198 for assisting the movement of operator means 200 upwardly. The differential area between the seal effective areas of seal means 201 and 203 defines the control piston area of control pressure chamber means 202. The differential area between the seal effective areas of seal means 203 and 147 (See FIGS. 9B and 10B), defines the balance piston area of balance pressure chamber means 204. The control piston area and balance piston area are designed to be substantially equal. Likewise the seal effective areas of seal means 201 and 147 are designed to be substantially equal so that operator means 200 is pressure balanced to well fluids within the bore 207. Means 205 for resiliently urging operator means upwardly is provided by spring means 205. When operator means 200 is in its uppermost, first position (See FIG. 15), the flow path through the subsurface safety valve 190 is closed. When operator means 200 is in its lower most, second position (see FIG. 16), the flow path through the subsurface safety valve 190 is opened.

To communicate control fluid between the surface and both control pressure means 202 and balance chamber means 204, connector means 206 is attached to valve housing means 198 adjacent to control pressure chamber means 202. Connector means 206 also forms pilot valve housing means 206.

Pilot valve means controls the passage of control fluid between control conduit means 192 and control pressure chamber means 202. Pilot valve means also enables the pressure balancing of operator means 200. Additionally, control fluid from control conduit means 912 is prevented from affecting balance pressure chamber means 204 and control fluid from balance conduit means 194 is prevented from communicating to control conduit means 192.

For communicating control fluid between control conduit means 192 and control pressure chamber means 202, pilot valved flow passage means extends through connector means 206. Connector means 206 includes first port means 208 having a thread 208*a* at its upper end. Thread 208*a* receives the lower end of control conduit means 192. First port means 208 opens into pilot valve chamber means 210 which is formed within pilot valve housing means 206. Passage means 212 extends between pilot valve chamber means 210 and control pressure chamber means 202. One valve means of the pilot valve means, controls fluid flow between control conduit means 192 and control pressure chamber means 202 by controlling fluid communication between port means 208 and passage means 212.

The one valve means may include the one pilot valve head means 80''' and seal means 82''' on pilot valve member means 78'''. (These elements are similar to elements previously described for the first two embodiments of this invention. Similar elements for this embodiment have been designated with the same numeral designated as previous embodiments except for the addition of a '''.) The one valve means prevents flow when pilot valve means is in its first operative position (See FIGS. 15 and 17). At that time, seal means 82''' is received within seal bore means 214. Seal bore means 214 is formed in pilot valve housing means 206 in a portion of first port means 208.

Operator means 200 is pressure balanced with the pilot valve means is in its first operative position. A valved, passageway means 216 communicates between pilot valve chamber means 210 and balance pressure chamber means 204. Passageway means 216 therefore includes at least a portion extending through pilot valve housing means 206 and another portion extending through valve housing means 198. The other valve means, including the other valve head means 92''' and seal means 94''' on pilot valve member means 78''', controls flow through passageway means 216. Flow through passageway means 216 is prevented when pilot valve means is in its second operative position (See FIG. 16). In that second operative position, seal means 94''' is received within seal bore means 218. Seal bore means 218 is also formed in pilot valve housing means 206. It comprises a portion of passageway means 216.

Fluid communicates between balance conduit means 194 and balance pressure chamber means 204 through connector means 206. Connector means 206 includes aperture means 220 (See FIG. 17) having a thread 220*a* at is upper end. The lower end of balance conduit means 194 is attached to the thread 220*a*. Aperture means 220 communicates with passageway means 216. Fluid flows between balance conduit means 194 and balance pressure chamber means 204 through aperture means 220 and passageway means 216.

Fluid flow between balance conduit means 194 and control conduit means 192 is prevented by pilot valve member means 78'''. When pilot valve member means 78''' is in a first position (See FIGS. 15 and 17), the one valve means prevents flow between control conduit means 192 and balance conduit means 194. When pilot valve member means 78''' is in a second position (See FIG, 16), the other valve means prevents flow between control conduit means 192 and balance conduit means 194. One of these two valve means of pilot valve means prevents fluid flow between control conduit means 192 and balance pressure chamber means 204 during movement of pilot valve member means 78''' between its first and second positions. Thus, seal means 94''' would enter seal bore means 218 prior to the time seal means 84''' leaves seal bore means 214 and visa versa.

The subsurface safety valve 190 is operated in response to surface controls.

The subsurface safety valve 190 is opened when control conduit means 192 is pressurized.

Before control fluid pressure is built up in control conduit means 192, spring means 96''' maintains pilot valve member means 78''' in its first position preventing flow between control conduit means 192 and control pressure chamber means 202. Therefore, there is not that minimal amount of fluid pressure within control pressure chamber means 202 that will move operator means 200 downwardly. Operator means 200 remains in its upward position. The flow path through the safety valve is closed by valve closure means.

When it is desired to open the subsurface safety valve 190, operating manifold 196 increases the pressure of control fluid within control conduit means 192. When the pressure within port means 208 reaches a sufficient amount, the means responsive to control pressure within the pilot valve means moves pilot valve member means 78''' downwardly. During the first portion of the downward movement of pilot valve member means 78''', the means responsive to control pressure includes the one valve head means 80''' and seal means 82'''. When seal means 82''' disengages from seal bore means 214, the means responsive to control pressure comprises the other valve head means 92''' and seal means 94''' which has by now entered seal bore means 218.

As long as the pressure of control fluid within pilot valve chamber means 210 is sufficient to hold pilot valve member means 78''' in the position shown in FIG. 16, control fluid communicates between control conduit means 192 and control pressure chamber means 202. Operating manifold 196 increases the pressure of control fluid within control conduit means 192 until the pressure within control pressure chamber means 202 reaches the minimal amount which will move operator means 200 downwardly. When operator means 200 is moved to its lower most position, the flow path through the subsurface safety valve 190 is opened.

During opening of the subsurface safety valve 190, fluid within balance pressure chamber means 204 will be forced into balance conduit means 194. The presence of fluid within the balance pressure chamber means 204 will not prevent the opening of the subsurface safety valve 190. Operating manifold 196 may increase the pressure of fluid with control conduit means 192 to any minimal amount that will move operating means 200 downwardly. The fluid pressure within control conduit means 192 eventually will reach that minimal amount wherein the downward pressure force exerted upon operator means 200 is greater than the combined upward forces exerted upon operator means 200.

Once the subsurface flow path through the housing bore is opened, it remains open as long as pilot valve means is in its second operative position. Pilot valve means will remain in its second operative position when the pressure force of control fluid is greater than the sum of the force of spring means 96''' and the pressure force of balance fluid.

Upon reduction of the pressure of control fluid within control conduit means 192, for whatever reason, spring means 96''' will move pilot valve member means 78''' from the position shown in FIG. 16 to the position shown in FIG. 15. Thereafter, control fluid will be prevented from flowing between control conduit means 192 and control pressure chamber means 202. Additionally, a substantial pressure balancing of operator means 200 will be permitted.

The pressure balancing will occur due to the fluid communication between control pressure chamber means 202 and balance pressure chamber means 204. Once pilot valve means is in its second operative position permitting communication between passage means 212 and passageway means 216, the energy stored by spring means 205 results in movement of operator means 200 upwardly. Fluid within control pressure chamber means 202 will be forced into balance pressure chamber means 204.

The reduction of control fluid pressure in control conduit means 192, should render spring means 96''' effective to move pilot valve member means 78''' upwardly to its first position shown in FIGS. 15 and 17. The flow path through the subsurface safety valve would thereby be closed.

However, if for some reason, pilot valve member means 78''' should stick in its second position, shown in FIG. 16, it may be moved to its first position by pressurizing the fluid within balance conduit means 194. The pressurized fluid would flow through aperture means 220 and be effective across seal means 94'''.

Eventually the fluid pressure force within aperture means 202 across seal means 94''' will be great enough to unstick pivot valve means 78''' and move it to its first position. Once pilot valve member means 78''' is in its first position, operator means 200 becomes substantially pressure balanced. Spring means 205 moves operator means 200 upwardly to close the subsurface flow path as previously explained.

If pilot valve mebmer means 78''' does become stuck in its second position, balance conduit means 194 should be pressurized only enough to unstick pilot valve member means 78'''. Thereafter, balance conduit means 194 should be depressurized. If balance conduit means 194 remains pressurized while the control fluid is trading places between control pressure chamber means 202 and balance pressure chamber means 204, seal means 203 will be forced into tighter frictional engagement with valve housing means 198. That frictional engagement of seal means 203 will retard to some extend the upward movement of operator means 200.

Figure 18:
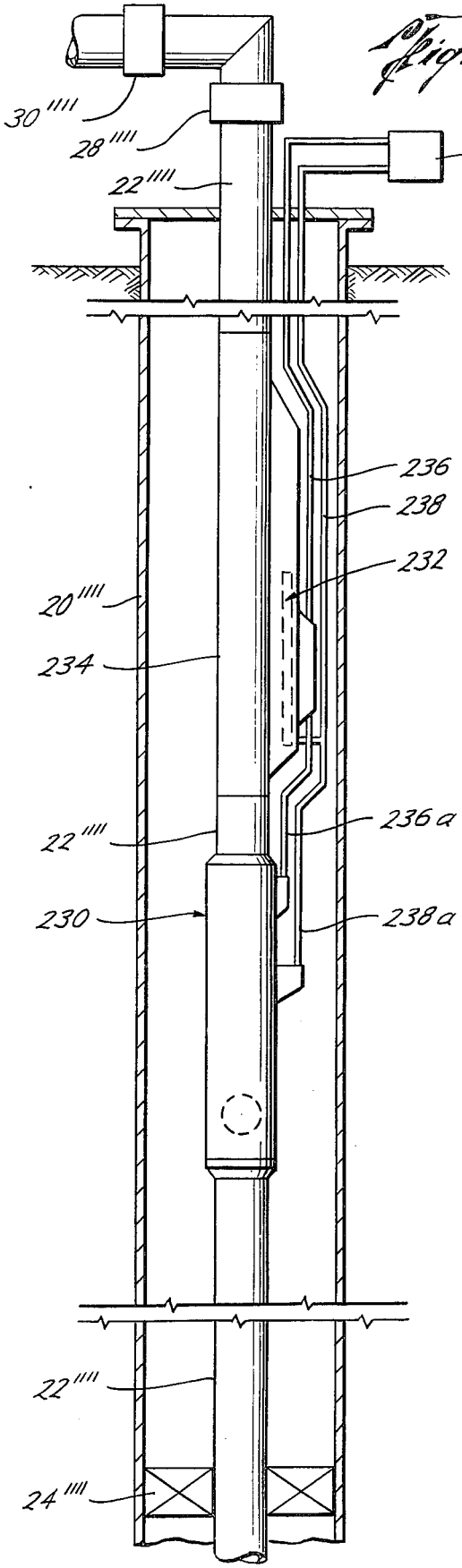
FIG. 18 is a schematic illustration of another well installation in accordance with another embodiment of this invention.

The well installation of FIG. 18 utilizes dual conduit means for controlling operation of a subsurface safety valve 230. The pilot valve means 232 is positioned at a subsurface location in the well in side pocket mandrel 234. The well is cased at 20'''' and includes the tubing string 22''''. The side pocket mandrel 234 and subsurface safety valve 230 are both positioned within the tubing string 22'''' in close proximity to each other. Packer means 24'''' confines flow from the producing formation (not shown) to within the tubing string 22''''. Subsurface safety valve 230 controls flow through the tubing string 22'''' at a subsurface location while surface valves 28'''' and 30'''' control flow at the surface.

For controlling the subsurface safety valve 230 from the surface, control conduit means 236 and balance conduit means 238 extend between operating manifold 240 and the subsurface safety valve 230.

Pilot valve means 232 controls the flow of control fluid within control conduit means 236 between operating manifold 240 and the subsurface safety valve 230. In a first operative position of pilot valve means 232, control fluid from control conduit means 236 is prevented from communicating to the subsurface safety valve 230. Additionally, a substantial pressure balancing of the subsurface safety valve's operator is permitted. In a second operative position of pilot valve means 232, control fluid communicates between control conduit means 236 and the subsurface safety valve 230. Fluid within balance conduit means 238 may be pressurized to control pilot valve means 232 in the event that the pilot valve mechanism becomes stuck in its second position. In either position of pilot valve means 232, comingling of fluid between control conduit means 236 and balance conduit means 238 is prevented.

The subsurface safety valve 230 illustrated in FIG. 18 is a tubing removable surface controlled subsurface safety valve. It includes an operator responsive to fluid pressure within a control pressure chamber and a balance pressure chamber. Those skilled in the art could adapt such a subsurface safety valve to be wire line retrievable or to be useable with pumpdown equipment.

Figure 19:
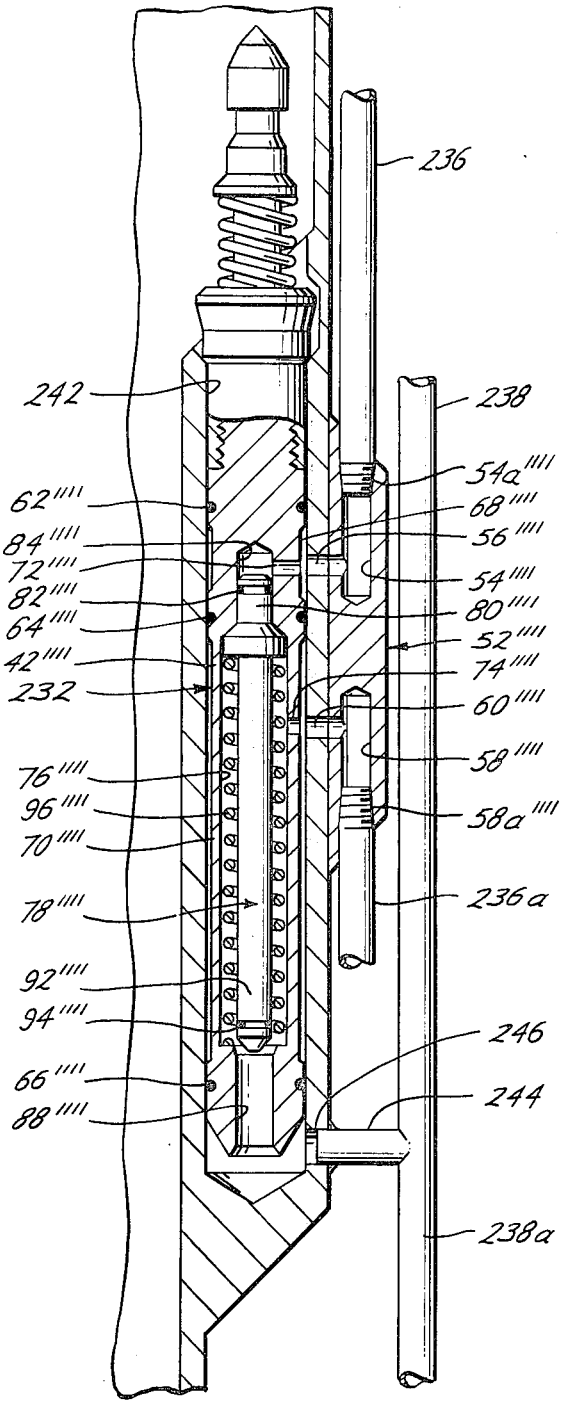
FIG. 19 is a view, partly in section and partly in elevation, illustrating a form of pilot valve useable in the well installation of FIG. 18.

The detailed structure of pilot valve means 232 is illustrated in FIG. 19. It is shown locked within the side pocket receptacle 242 of side pocket mandrel 234.

The pilot valve means 232 of this embodiment is the same as pilot valve means 36 of the first embodiment of this invention. Its corresponding elements have been identified with corresponding numerals except for the addition of a ''''.

Connector means 52'''' is attached to the side pocket mandrel 234 adjacent to the location of pilot valve means 232 therein. Connector means 52'''' is the same as connector means 52 of the first embodiment of this invention. Its corresponding elements have been designated with corresponding numerals except for the addition of a ''''.

Side pocket mandrel 234 is similar to side pocket mandrel 40 previously described. It has port means 56'''' and 60'''' for communicating control fluid between control conduit means 236 and pilot valve chamber means 76''''.

The lower end of pilot valve means 232 is placed in communication with balance fluid within balance conduit means 236. Connector means 244 is attached to the side pocket mandrel 234. Balance fluid communicates from balance conduit means 236 to pilot valve means 232 through connector means 244 and port means 246 in the side pocket mandrel 234.

The subsurface safety valve 230 may be positioned within the tubing string 22'''' by known techniques.

In close proximity thereto is positioned side pocket mandrel 234.

Pilot valve means 232 may be positioned within the side pocket receptacle 242 of side pocket mandrel 234 utilizing a kickover tool as disclosed in the aforementioned U.S. Pat. No. 3,837,398.

Once the subsurface safety valve 230 and pilot valve means 232 have been installed, subsurface flow through the safety valve 230 may be controlled from the surface in accordance with this invention.

When control fluid in control conduit means 236 is not pressurized a sufficient amount, pilot valve means 234 will remain in its first operative position (See FIG. 19). Control fluid will not be permitted to communicate between control conduit means 236 and the subsurface safety valve 230. There will not be that minimal pressurization of fluid within the control pressure chamber of the subsurface safety valve 230 which will open the subsurface flow path. The flow path through the subsurface safety valve 230 will remain closed.

To open the flow path through the subsurface safety valve 230, control fluid within control conduit means 236 is pressurized at the surface by operating manifold 240. When the pressure of fluid within control conduit means 236, which is effective across seal means 82'''', reaches a sufficient amount, pilot valve member means 78'''' moves downwardly from the position shown in FIG. 19. Seal means 94'''' enters seal bore means 88'''' and seal means 82'''' leaves seal bore means 84''''. Thereafter, the pressure effective area of pilot valve means 232 is defined by second seal means 94''''. Pilot valve means 232 attains its second operative position. Control fluid communicates between control conduit means 236 and the control pressure chamber of the subsurface safety valve 230. The pressure of the control fluid is increased by operating manifold 240 until it attains the minimal amount which opens the subsurface safety valve 230.

In the second operative position of pilot valve means 232 the other valve means of pilot valve means 232 prevents dissipation of control fluid. Control fluid dissipation is prevented by preventing communication between control conduit means 236 and the balance conduit means 238.

Normally, when the pressure of control fluid within control conduit means 236 is reduced below a sufficient amount, spring means 96'''' moves pilot valve member means 78'''' back to the position shown in FIG. 19. In that first operative position of pilot valve means 232, fluid flow between control conduit means 236 and the control pressure chamber of the subsurface safety valve 230 is prevented. Additionally, a substantial pressure balancing of the operator of the subsurface safety valve 230 is permitted. The balance pressure chamber and the control pressure chamber of the safety valve 230 are in fluid communication. The control fluid trades places between the control pressure chamber and the balance pressure chamber means. The control fluid flows through that portion **236*a* of control conduit means 236 extending between the subsurface safety valve 230 and the side pocket mandrel 234, pilot valve chamber means 76'''', and that portion 238*a* of balance conduit means 238 extending between side pocket mandrel means 234 and the subsurface safety valve 230. Due to the design of the subsurface safety valve's control pressure chamber and balance pressure chamber, the fluid trades places with little, if any, displacement of fluid into that portion of balance conduit means 238 extending above the side pocket mandrel 234. The resilient urging biasing means of the subsurface safety valve 230 may therefore return the subsurface safety valve 230 to its flow path closing position quickly. Quick closure is permissible because a force that will cause the control fluid to trade places between the control pressure chamber and the balance pressure chamber is much less than the force required to displace fluid into balance conduit means 238** as has heretofore been the practice.

If pilot valve member means 78'''' sticks in its lower most position, (e.g., the second operative position of pilot valve means 232) balance conduit means 238 may be pressurized to provide a positive force to move pilot valve member means 78'''' to its upper position shown in FIG. 19. The pressurized fluid within balance conduit means 238 will be effective across the second seal means 94''''. When the pressure of fluid within balance conduit means 238 is great enough, pilot valve member means 78'''' will be moved upwardly. Thereafter, the control fluid may trade places between the control pressure chamber of the subsurface safety valve 230 and the balance pressure chamber. Again, the fluid trades places with little, if any, displacement of fluid into the portion of balance conduit means 238 extending above the side pocket mandrel 234. Once the pilot valve member means 78'''' has been unstuck, closure of the subsurface safety valve 230 is quick.

From the foregoing it can be seen that the objects of this invention have been obtained. A subsurface safety valve has been provided which is normally closed and which is capable of returning to its flow path closing position much faster than present subsurface safety valves. The faster closure is due to several factors. First of all, a much smaller volume of control fluid is displaced against the fluid forces due to a hydrostatic head of fluid in the control conduit than has heretofore been the practice. Once that small amount of control fluid is displaced, the operator of the subsurface safety valve is rendered substantially fluid pressure balanced. The large volume of control fluid within the control pressure chamber of the subsurface safety valve is thereafter easily displaced. The control fluid may be displaced to the flow path through the subsurface safety valve or to a chamber below the operating piston. That easy displacement of control fluid enbles the spring or other resilient urging means of the subsurface safety valve to quickly move the valve closure element to its flow path closing position. (Were it necessary to displace the control fluid either into the control line or balance line in the conventional manner, the evacuation of this chamber and the upward movement of the operator would be slow. The closing of present safety valves is thus much delayed over the closure of subsurface safety valves in accordance with this invention.) Additionally, the control fluid within the control conduit is effective across a very small piston area. A relatively weaker spring or a relatively weaker resilient biasing force generating means, than are presently used for subsurface safety valves, may be used to resist the fluid forces effective across that small piston area. These factors enable quick closure of the subsurface safety valve of this invention, which quickness is of utmost importance because the subsurface safety valve is meant to close when a dangerous condition such as a fire or storm threatens.

The foregoing disclosure and description of this invention is illustrative and explanatory thereof. Various changes in the size, shape, and materials, as well as in the details of the illustrated construction, may be made within the scope of the appended claims without departing from the spirit of the invention.

What is claimed is:

1. A surface controlled subsurface safety valve comprising:

valve housing means for defining a flow path;

valve closure means associated with said valve housing means and adapted for movement between positions opening and closing said flow path;

means responsive to control pressure, including control pressure chamber means, and adapted to move said valve closure means to a position opening said flow path when said control pressure chamber means is pressurized a minimal amount;

means for resiliently urging said valve closure means to a position closing said flow path;

pilot valve means having a first position wherein pressurized control fluid is prevented from communicating to said control pressure chamber means and wherein said means responsive to control pressure is at least substantially pressure balanced and is affected by substantially equal but opposite fluid pressure forces and having a second position wherein pressurized control fluid communicates with said control pressure chamber means, said pilot valve means including:

valve means for controlling communication of control fluid to said control pressure chamber means, means for resiliently biasing said valve means to said first position, and pressure responsive means for moving said valve means to said second position when said means is pressurized a sufficient amount.

2. The surface controlled subsurface safety value of claim 1 additionally including:

valved passageway means for communicating between said control pressure chamber means and said flow path when said pilot valve means is in said first position; and port means for continuously communicating fluid between said flow path and a location affecting said means responsive to control pressure to at least substantially pressure balance said means responsive to control pressure when said pilot valve means is in said first position.

3. The surface controlled subsurface safety valve of claim 1 wherein:

said pilot valve means includes pilot valve housing means associated with said valve housing means and positioned in close proximity to said control pressure chamber means;

said pilot valve housing means includes at least a portion of:

port means adapted for communicating with control conduit means extending from the surface, passage means for communicating between said port means and said control pressure chamber means, and passageway means for communicating between said passage means and said flow path;

said valve means comprises:

first seal bore means in said port means, pilot valve member means axially movable within said pilot valve housing means and having one valve head means adapted to be received within said first seal bore means, and first seal means for sealing between said one valve head means and said first seal bore means;

second seal bore means in said passageway means, another valve head means on said pilot valve member means and adapted to be received within said second seal bore means, and second seal means for sealing between said other valve head means and said second seal bore means;

wherein said one valve head means is received within said first seal bore means and pressurized fluid at said port means is effective across said first seal means when said pilot valve means is in said first position; and wherein said other valve head means is received within said second seal bore means and pressurized fluid is effective across said second seal means when said pilot valve means is in said second position.

4. The surface controlled subsurface safety valve of claim 1 wherein:

said pilot valve means includes pilot valve housing means;

said pilot valve housing means comprises an extension of said valve housing means and includes at least a portion of:

port means adapted for communicating with control conduit means extending from the surface, and passage means for communicating between said port means and said control pressure chamber means;

said valve means comprises:

sleeve pilot valve member means axially movable within said pilot valve housing means, first annular seal bore means within said pilot valve housing means, first seal means for sealing between said sleeve pilot valve member means and said first annular seal bore means, second annular seal bore means within said pilot valve housing means and spaced from said first annular seal bore means, and second seal means for sealing between said sleeve pilot valve member means and said second annular seal bore means; and said pressure responsive means comprises:

pilot valve chamber means formed between said pilot valve housing means and said sleeve pilot valve member means wherein pressurized fluid is effective across said first seal means when said sleeve pilot valve member means is in said first position and preventing flow between said passage means and said port means and wherein pressurized fluid is effective across said second seal means when said sleeve pilot valve member means is in said second position and permitting flow between said passage means and said port means.

5. The surface controlled subsurface safety valve of claim 4 wherein:

said passage means opens into said pilot valve chamber means between said first and second seal bore means; and said port means opens into said pilot valve chamber means at one extremity of said first seal bore means where said first seal means may be effective to prevent flow between said port means and said passage means.

6. The surface controlled subsurface safety valve of claim 4 wherein:

at said first position of said valve means said second seal means is spaced from said second annular seal bore means and said passage means communicates with said flow path; and additionally including port means for continuously communicating fluid between said flow path and a location affecting said means responsive to control pressure to thereby at least substantially pressure balance said control pressure responsive means when said valve means is in said first position.

7. The surface controlled subsurface safety valve of claim 1 additionally including:

balance pressure responsive means for offsetting the hydrostatic pressure force which affects said control pressure responsive means, said means including balance pressure chamber means; and valved passageway means for communicating between said control pressure chamber means and said balance pressure chamber means when said pilot valve means is in said first position to at least substantially pressure balance said means responsive to control pressure.

8. The surface controlled subsurface safety valve of claim 1 additionally including:

balance pressure responsive means for offsetting the hydrostatic pressure force which affects said control pressure responsive means; and wherein:

said pilot valve means includes pilot valve housing means;

said pilot valve housing means has at least a portion of:

port means adapted for communicating with control conduit means extending from the surface, passage means for communicating between said port means and said control pressure chamber means, passageway means for communicating between said passage means and said balance pressure chamber means and also adapted for communicating with balance conduit means extending from the surface; and said valve means includes:

pilot valve member means movable within said pilot valve housing means, first seal bore means formed in said port means, first seal means carried on said pilot valve member means for sealing between said first seal bore means and said pilot valve member means when said pilot valve means is in said first position, second seal bore means formed in said passageway means, second seal means carried on said pilot valve member for sealing between said second seal bore means and said pilot valve member means when said pilot valve means is in said second position.

9. A surface controlled subsurface safety valve comprising:

valve housing means for defining a flow path;

valve closure means associated with said valve housing means and adapted for movement between positions opening and closing said flow path;

means responsive to control pressure, including control pressure chamber means, and adapted to move said valve closure means to a position opening said flow path when said control pressure chamber means is pressurized a minimal amount and continuously affected by the pressure of fluid from a region not associated with the source of control fluid pressure;

means for resiliently urging said valve closure means to a position closing said flow path; and means for controllably pressurizing said control pressure chamber means and including:

pilot valve housing means, port means adapted for communicating with control conduit means extending from the surface and including at least a portion extending through said pilot valve housing means, passage means for communicating between said port means and said control pressure chamber means and including at least a portion in said pilot valve housing means, valve means within said pilot valve housing means for controlling flow between said port means and said passage means, means for resiliently biasing said valve means to a first position preventing flow between said port means and said passage means, means for at least substantially pressure balancing said means responsive to control pressure when said valve means is in said first position and including means for communicating between said passage means and said pres sure region; and pressure responsive means for moving said valve means to a second position permitting flow between said port means and said passage means when said port means is pressurized a sufficient amount.

10. A surface controlled subsurface safety valve comprising:

valve housing means for defining a flow path;

valve closure means associated with said valve housing means and adapted for movement between positions opening and closing said flow path;

means responsive to control pressure, including control pressure chamber means, and adapted to move said valve closure means to a position opening said flow path when said control pressure chamber means is pressurized and continuously affected by the pressure of fluid from a region not associated with the source of control fluid pressure;

means for resiliently urging said valve closure means to a position closing said flow path;

passage means for communicating with said control pressure chamber means;

passageway means for selectively communicating with said passage means and for continuously communicating with said pressure region to at least substantially pressure balance said means responsive to control pressure when in communication with said passage means;

port means adapted for communicating with control conduit means extending from the surface and for communicating with said passage means;

two-way valve means for controlling flow between said passage means and a selected one of said passageway means and said port means;

means for biasing said two-way valve means to a first position wherein flow between said passage means and said passageway means is permitted and flow between said passage means and said port means is prevented;

pressure responsive means for moving said two-way valve means to a second position wherein flow between said passage means and said port means is permitted and flow between said passage means and said passageway means is prevented, said pressure responsive means moving said valve means to said second position when acted upon by fluid pressurized a sufficient amount.

11. A surface controlled subsurface safety valve comprising:

valve housing means for defining a flow path;

valve closure means associated with said valve housing means and adapted for movement between positions opening and closing said flow path;

means responsive to control pressure, including control pressure chamber means, and adapted to move said valve closure means to a position opening said flow path when said control pressure chamber means is pressurized and continuously affected by the pressure of fluid from a region not associated with the source of the control fluid pressure;

means for resiliently urging said valve closure means to a position closing said flow path;

pilot valve housing means, associated with said valve housing means and including at least a portion of:

port means adapted for communicating with a conduit extending from the surface to said port means, and passage means for communicating between said port means and said control pressure chamber means;

means for at least substantially pressure balancing said means responsive to control pressure and including means for communicating with said region;

pilot valve member means movable with respect to said pilot valve housing means, said pilot valve member means including two valve head means and configured so that when in a first position one of said two valve head means prevents flow between said passage means and said port means while the other of said two valve head means opens said means for at least substantially pressure balancing and so that when in a second position said one valve head means permits flow between said passage means and said port means while said other valve head means closes said means for at least substantially pressure balancing, means for resiliently biasing said pilot valve member means to said first position, pressure responsive means for moving said pilot valve member means to said second position.

12. In a subsurface well installation having a tubing string, apparatus for controlling flow in the well at a subsurface location, the apparatus comprising:

a side pocket mandrel adapted to be positioned in the tubing string and having a bore extending therethrough and also having a side pocket receptacle;

a subsurface safety valve adapted to be positioned in the tubing string in close proximity to said side pocket mandrel and including:

valve housing means for defining a flow path, valve closure means associated with said valve housing means and adapted for movement between positions opening and closing said flow path, means responsive to control pressure, including control pressure chamber means, and adapted to move said valve closure means to a position opening said flow path when said control pressure chamber means is pressurized a minimal amount, and means for resiliently urging said valve closure means to a position closing said flow path;

first port means through said side pocket mandrel opening into said side pocket receptacle and adapted for communicating with control conduit means extending from the surface;

passage means, opening into said side pocket receptacle, for communicating between said side pocket receptacle and said control pressure chamber means; and pilot valve means adapted to be disposed in said side pocket receptacle and having a first position wherein pressurized control fluid is prevented from communicating between said first port means and said passage means and wherein said means responsive to control pressure is at least substantially pressure balanced and is affected by substantially equal but opposite fluid pressure forces and having a second position wherein pressurized control fluid communicates between said first port means and said passage means, said pilot valve means including:

pilot valve housing means adapted to be received within said side pocket receptacle, spaced seal means on said pilot valve housing means for sealing between said pilot valve housing means and said side pocket receptacle and for defining two pressure regions around said pilot valve housing means, one pressure region being adjacent to the opening of said first port means into said side pocket receptacle and the other pressure region being adjacent to the opening said passage means into said side pocket receptacle, valve means for controlling flow between said two pressure regions, means for resiliently biasing said valve means to said first position, and pressure responsive means for moving said valve means to said second position when said means is pressurized a sufficient amount.

13. In a well installation having a subsurface flow path; a subsurface safety valve, including means responsive to control pressure, for controlling flow through the subsurface flow path; and a control conduit to communicate control fluid for operating the subsurface safety valve, pilot valve means comprising:

pilot valve housing means adapted to be positioned at a subsurface location in the well installation in close proximity to the subsurface safety valve;

said pilot valve housing means having at least a portion of:

port means adapted for communicating with said control conduit, and passage means for communicating between said port means and the subsurface safety valve;

valve means movable with respect to said pilot valve housing means between a first position wherein control fluid is prevented from communicating between said port means and said passage means and wherein the means responsive to control pressure of the subsurface safety valve is at least substantially pressure balanced and is affected by substantially equal but opposite fluid pressure forces and a second position wherein control fluid communicates between said port means and said passage means;

means for resiliently biasing said valve means to said first position; and pressure responsive means for moving said valve means to said second position when said port means is pressurized a sufficient amount.

* * * * *

UNITED STATES PATENT AND TRADEMARK OFFICE

CERTIFICATE OF CORRECTION

PATENT NO. : 4,119,146

DATED : October 10, 1978

INVENTOR(S) : Frank H. Taylor

It is certified that error appears in the above-identified patent and that said Letters Patent are hereby corrected as shown below:

Column 1, line 30, "closed" should read "disclosed"

Column 11, line 7, "effecitve" should read "effective"

Column 11, line 9, "are" should read "area"

Column 12, line 20-21 "down-wardlly" should read "downwardly"

Column 13, line 5, "9BO" should read "9B"

Column 14, line 27, "34'" should read "32'"

Column 18, line 61, "disipated" should read "dissipated"

Column 21, line 1, "912" should read "192"

Column 21, line 33, "with" should read "when"

Column 21, line 54, "is" should read "its"

UNITED STATES PATENT AND TRADEMARK OFFICE

CERTIFICATE OF CORRECTION

PATENT NO. : 4,119,146

DATED : October 10, 1978

INVENTOR(S) : Frank H. Taylor

It is certified that error appears in the above-identified patent and that said Letters Patent are hereby corrected as shown below:

Column 23, line 34, "pivot" should read "pilot"

Column 23, line 40, "mebmer" should read "member"

Column 23, line 50, "extend" should read "extent"

Column 24, line 15, "comingling" should read "commingling"

Column 30, line 17, "pres sure" should read "pressure"

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*